US011244645B2

(12) United States Patent
Park et al.

(10) Patent No.: US 11,244,645 B2
(45) Date of Patent: Feb. 8, 2022

(54) LEVEL SHIFTER RESISTANT TO ELECTROMAGNETIC INTERFERENCE AND DISPLAY DEVICE INCLUDING SAME

(71) Applicant: LG Display Co., Ltd., Seoul (KR)

(72) Inventors: Se-Dong Park, Paju-si (KR); Soon-Dong Cho, Gumi-si (KR); Dong-Ju Kim, Gumi-si (KR); Hee-Jung Hong, Seoul (KR); Jung-Jae Kim, Goyang-si (KR)

(73) Assignee: LG Display Co., Ltd, Seoul (KR)

( * ) Notice: Subject to any disclaimer, the term of this patent is extended or adjusted under 35 U.S.C. 154(b) by 0 days.

(21) Appl. No.: 16/929,810

(22) Filed: Jul. 15, 2020

(65) Prior Publication Data

US 2021/0020134 A1 Jan. 21, 2021

(30) Foreign Application Priority Data

Jul. 16, 2019 (KR) ..... 10-2019-0085975

(51) Int. Cl.

| | |
|---|---|
| ***G09G 3/36*** | (2006.01) |
| *G09G 3/3266* | (2016.01) |
| *G09G 3/3275* | (2016.01) |

(52) U.S. Cl.

CPC ..... *G09G 3/3677* (2013.01); *G09G 3/3688* (2013.01); *G09G 3/3266* (2013.01); *G09G 3/3275* (2013.01); *G09G 2310/0286* (2013.01); *G09G 2310/0289* (2013.01); *G09G 2310/08* (2013.01); *G09G 2330/06* (2013.01)

(58) Field of Classification Search

CPC ..... G09G 3/3677; G09G 3/3688; G09G 2310/08; G09G 3/3266; G09G 3/3275; G09G 2310/0286; G09G 2330/06; G09G 2310/0289

See application file for complete search history.

(56) References Cited

U.S. PATENT DOCUMENTS

| | | | | |
|---|---|---|---|---|
| 2006/0256099 | A1 | 11/2006 | Tashiro | |
| 2008/0101529 | A1 | 5/2008 | Tobita | |
| 2008/0219401 | A1 | 9/2008 | Tobita | |
| 2014/0191935 | A1* | 7/2014 | Morii | G09G 3/3677 345/92 |
| 2015/0269900 | A1* | 9/2015 | Iwamoto | G09G 3/3688 345/100 |
| 2016/0189648 | A1* | 6/2016 | Xiao | G11C 19/28 345/212 |
| 2019/0311667 | A1* | 10/2019 | Qian | G11C 7/04 |

FOREIGN PATENT DOCUMENTS

| | | | |
|---|---|---|---|
| JP | 2007-58202 | A | 3/2007 |
| JP | 4912186 | B2 | 4/2012 |
| JP | 5079301 | B2 | 11/2012 |
| KR | 10-2006-0118334 | A | 11/2006 |

* cited by examiner

*Primary Examiner* — Kwang-Su Yang

(74) *Attorney, Agent, or Firm* — Morgan, Lewis & Bockius LLP

(57) ABSTRACT

A display device includes a display panel and a level shifter. The display panel displays images. The level shifter includes a signal pad through which a clock signal to drive the display panel is output and a reverse signal pad through which a reverse clock signal different from the clock signal is output, and the reverse signal pad is in an electrically floated state.

15 Claims, 26 Drawing Sheets

(a)

(b)

LEVEL SHIFTER RESISTANT TO ELECTROMAGNETIC INTERFERENCE AND DISPLAY DEVICE INCLUDING SAME

BACKGROUND

Technical Field

The present disclosure relates to a level shifter and a display device including the same.

Discussion of the Related Art

With the development of information technology, the market for display devices that are connecting media between users and information is expanding. Accordingly, display devices such as an organic light emitting display (OLED), a quantum dot display (QDD), a liquid crystal display (LCD) and a plasma display panel (PDP) are increasingly used.

Some of the aforementioned display devices, for example, an LCD or an OLED includes a display panel including a plurality of subpixels arranged in a matrix, a driver which outputs a driving signal for driving the display panel, and a power supply which generates power to be supplied to the display panel and the driver. The driver includes a scan driver which supplies scan signals (or gate signals) to the display panel and a data driver which supplies data signals to the display panel.

The aforementioned display device can display an image in such a manner that selected subpixels transmit light or directly emit light when driving signals, for example, a scan signal and a data signal, are supplied to the subpixels formed in the display panel.

SUMMARY

Accordingly, embodiments of the present disclosure are directed to a level shifter and a display device that substantially obviate one or more of the problems due to limitations and disadvantages of the related art.

An object of the present disclosure for substantially obviating the aforementioned problems of the related art is to improve or complement problems that may be generated due to electromagnetic interference. Furthermore, another object of the present disclosure is to provide a scan driver including a level shifter and a shift register circuit robust against electromagnetic interference. Furthermore, another object of the present disclosure is to provide a display device including a scan driver that is robust against electromagnetic interference so that it can guarantee a smooth output state (characteristics, level, reliability and the like of a scan signal) even when electromagnetic interference occurs.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel and a level shifter. The display panel displays images. The level shifter includes a signal pad through which a clock signal to drive the display panel is output and a reverse signal pad through which a reverse clock signal having a reverse phase with the clock signal is output, and the reverse signal pad is in an electrically floated state.

The display device may further include a shift register circuit for outputting scan signals to be supplied to the display panel on the basis of the clock signal, a clock signal line connected to the signal pad, a reverse clock signal line connected to the reverse signal pad, the signal pad may be connected to the shift register circuit through the clock signal line, and the reverse signal pad may be connected to the reverse clock signal line while maintaining an electrically floated state.

The display device may further include an external substrate on which the level shifter is positioned, a flexible film connecting the display panel to the external substrate, and a data driver positioned on the flexible film and supplying a data signal to the display panel, and the reverse clock signal line may be wired on at least one of the external substrate, the flexible film and the display panel.

The clock signal line may include a plurality of clock signal lines, the reverse clock signal line may include a plurality of reverse clock signal lines, and the number of clock signal lines is equal to or different from the number of reverse clock signal lines.

The plurality of clock signal lines and the plurality of reverse clock signal lines may be alternately wired.

A level of the reverse clock signal may differ from a level of the clock signal.

At least one of a pulse generation time and a pulse end time of the reverse clock signal may differ from that of the clock signal.

In another aspect, the present invention provides a level shifter including a signal pad through which a clock signal is output and a reverse signal pad through which a reverse clock signal having a reverse phase with the clock signal is output, wherein the reverse signal pad is in an electrically floated state.

The level shifter may further include a clock signal line connected to the signal pad and a reverse clock signal line connected to the reverse signal pad, the signal pad may be connected to a circuit through the clock signal line and the reverse signal pad may be connected to the reverse clock signal line while maintaining an electrically floated state.

The clock signal line may include a plurality of clock signal lines, the reverse clock signal line may include a plurality of reverse clock signal lines, and the plurality of clock signal lines and the plurality of reverse clock signal lines may be alternately wired.

A level of the reverse clock signal may differ from a level of the clock signal.

At least one of a pulse generation time and a pulse end time of the reverse clock signal may differ from that of the clock signal.

The present disclosure has the effect of improving or complementing problems that may be generated due to electromagnetic interference. Furthermore, the present invention has the effect of providing a scan driver including a level shifter and a shift register circuit robust against electromagnetic interference. Furthermore, the present disclosure has the effect of providing a display device including a scan driver which is robust against electromagnetic interference so that it can guarantee a smooth output state (characteristics, level, reliability and the like of a scan signal) even when electromagnetic interference occurs.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Hereinafter, embodiments of the present invention will be described in detail with reference to the attached drawings.

With the development of information technology, the market for display devices that are connecting media between users and information is expanding. Accordingly, display devices such as a quantum dot display (QDD), a liquid crystal display (LCD), an organic light emitting display (OLED), and a plasma display panel (PDP) are increasingly used.

Some of the aforementioned display devices, for example, an LCD or an OLED includes a display panel including a plurality of subpixels arranged in a matrix, a driver which outputs a driving signal for driving the display panel, and a power supply which generates power to be supplied to the display panel and the driver. The driver includes a scan driver which supplies scan signals (or gate signals) to the display panel and a data driver which supplies data signals to the display panel.

The aforementioned display device can display an image in such a manner that selected subpixels transmit light or directly emit light when driving signals, for example, a scan signal and a data signal, are supplied to the subpixels formed in the display panel. Hereinafter, the present invention will be described using an LCD and an OLED as examples. Meanwhile, the present invention which will be described below is also applicable to display devices based on an inorganic light-emitting diode instead of an organic light-emitting diode.

Figure 1:
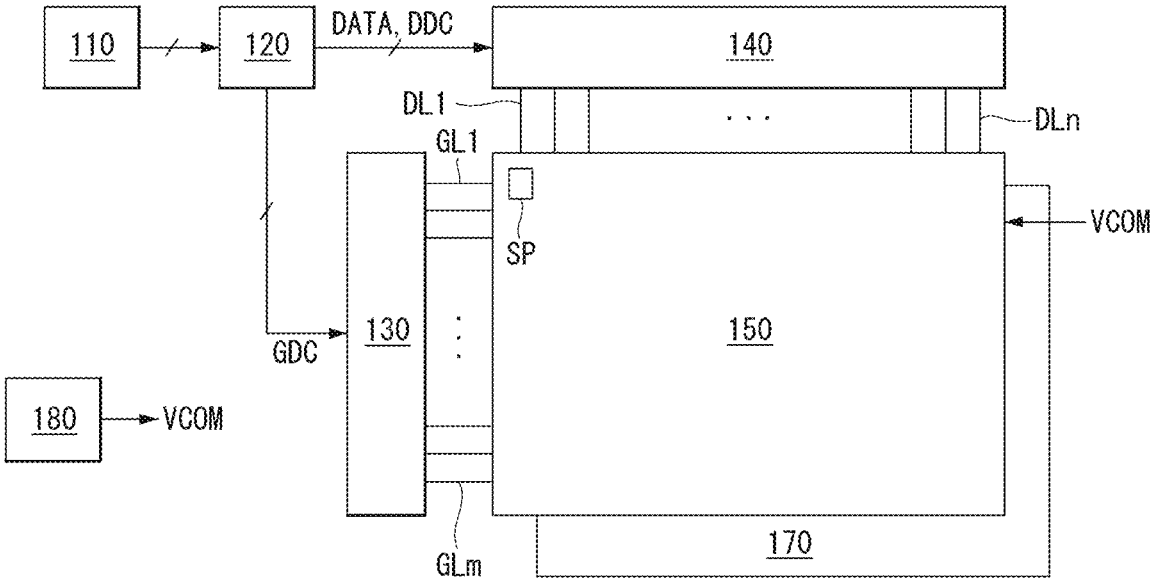
FIG. 1 is a block diagram schematically showing a liquid crystal display (LCD) and FIG. 2 is a circuit diagram schematically showing a subpixel shown in FIG. 1.
Figure 2:
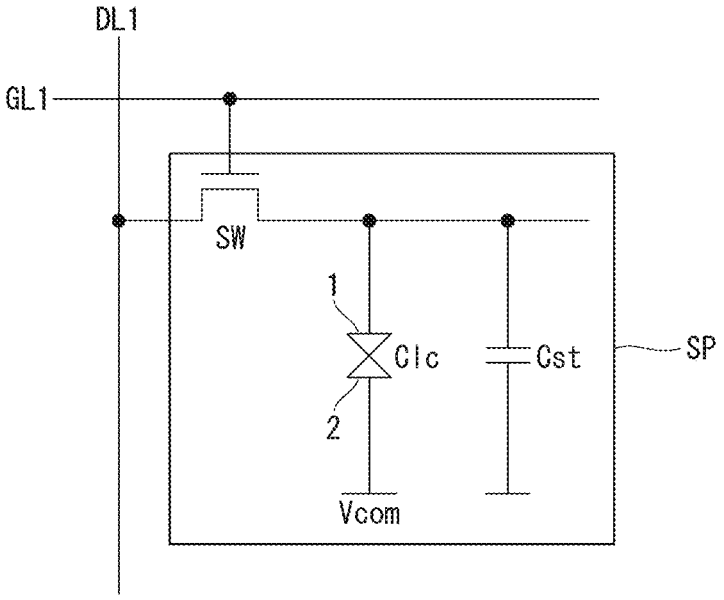

FIG. 1 is a block diagram schematically showing an LCD and FIG. 2 is a circuit diagram schematically showing a subpixel shown in FIG. 1.

As shown in FIGS. 1 and 2, the LCD includes an image provider 110, a timing controller 120, a scan driver 130, a data driver 140, a liquid crystal panel 150, a backlight unit 170, and a power supply 180.

The image provider 110 outputs various driving signals along with an externally provided image data signal or an image data signal stored in an internal memory. The image provider 110 supplies data signals and various driving signals to the timing controller 120.

The timing controller 120 outputs a gate timing control signal GDC for controlling operation timing of the scan driver 130, a data timing control signal DDC for controlling operation timing of the data driver 140, and various synchronization signals (a vertical synchronization signal Vsync and a horizontal synchronization signal Hsync). The timing controller 120 provides a data signal (or data voltage) DATA supplied from the image provider 110 to the data driver 140 along with the data timing control signal DDC.

The scan driver 130 outputs a scan signal (or gate signal) in response to the gate timing control signal GDC supplied from the timing controller 120. The scan driver 130 provides scan signals to subpixels included in the liquid crystal panel 150 through gate lines GL1 to GLm. The scan driver 130 is formed as an integrated circuit (IC) or directly formed on the liquid crystal panel 150 in a gate-in-panel form.

The data driver 140 samples and latches the data signal DATA in response to the data timing control signal DDC supplied from the timing controller 120, converts the data signal into a data voltage in the form of an analog signal corresponding to a gamma reference voltage and outputs the data voltage. The data driver 140 provides the data voltage to the subpixels included in the liquid crystal panel 150 through data lines DL1 to DLn. The data driver 140 may be formed as an IC and be mounted on the liquid crystal panel 150 or a printed circuit board, but the present invention is not limited thereto.

The power supply 180 generates and outputs a common voltage VCOM on the basis of an external input voltage supplied from the outside. The power supply 180 can generate and output a voltage (e.g., a scan high voltage or a scan low voltage) necessary to drive the scan driver 130 or a voltage (e.g., a drain voltage or a half drain voltage) necessary to drive the data driver 140.

The liquid crystal panel 150 displays an image in response to a scan signal supplied from the scan driver 130, a data voltage supplied from the data driver 140, and the common voltage VCOM supplied from the power supply 180. The subpixels of the liquid crystal panel 150 controls light provided through the backlight unit 170.

For example, a single subpixel SP includes a switching transistor SW, a storage capacitor Cst, and a liquid crystal layer Clc. A gate electrode of the switching transistor SW is connected to a scan line GL1 and a source electrode is connected to a data line DL1. One end of the storage capacitor Cst is connected to a drain electrode of the switching transistor SW and the other end is connected to a common voltage line Vcom. The liquid crystal layer Clc is formed between a pixel electrode 1 connected to the drain electrode of the switching transistor SW and a common electrode 2 connected to the common voltage line Vcom.

The liquid crystal panel 150 may be implemented in a twisted nematic (TN) mode, a vertical alignment (VA) mode, an in-plane switching (IPS) mode, a fringe field switching (FFS) mode, an electrically controlled birefringence (ECB) mode, or the like according to the structures of the pixel electrode 1 and the common electrode 2.

The backlight unit 170 provides light to the liquid crystal panel 150 using a light source emitting light, or the like. Although the backlight unit 170 may include light-emitting diodes (LEDs), an LED driver for driving the LEDs, an LED substrate on which the LEDs are mounted, a light guide for converting light emitted from the LEDs into planar light, a reflector for reflecting light under the light guide, optical sheets for condensing and diffusing light emitted from the light guide, and the like, the present invention is not limited thereto.

Figure 3:
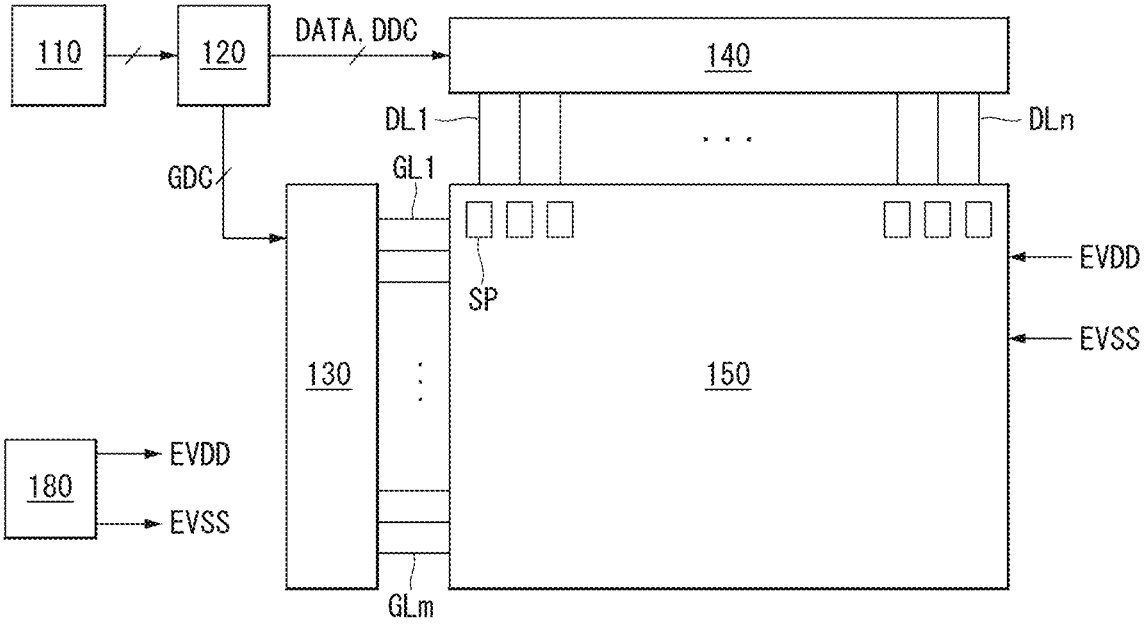
FIG. 3 is a block diagram schematically showing an organic light emitting display (OLED) and FIG. 4 is a configuration diagram schematically showing the subpixel shown in FIG. 3.
Figure 4:
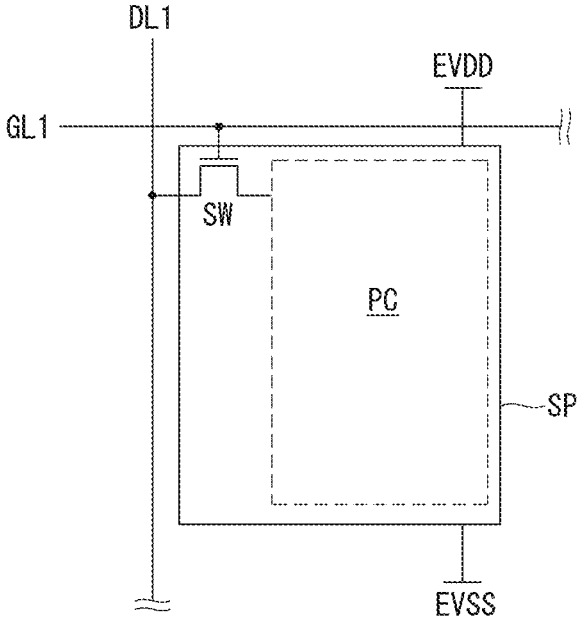

FIG. 3 is a block diagram schematically showing an organic light emitting display and FIG. 4 is a configuration diagram schematically showing the subpixel shown in FIG. 3.

As shown in FIGS. 3 and 4, the organic light-emitting display includes an image provider 110, a timing controller 120, a scan driver 130, a data driver 140, a display panel 150, and a power supply 180.

Basic configurations and operations of the image provider 110, the timing controller 120, the scan driver 130 and the data driver 140 included in the organic light emitting display are similar to those of the LCD of FIG. 1 and thus detailed description thereof is omitted. The power supply 180 and the display panel 150 distinguished from those of the LCD will be described in more detail.

The power supply 180 generates and outputs a first driving voltage EVDD having a high potential and a second driving voltage EVSS having a low potential on the basis of an external input voltage supplied from the outside. The power supply 180 can generate and output voltages (e.g., a scan high voltage and a scan low voltage) necessary to drive the scan driver 130 or voltages (e.g., a drain voltage and a half drain voltage) necessary to drive the data driver 120 as well as the first and second driving voltages EVDD and EVSS.

The display panel 150 displays an image in response to driving signals including a scan signal and a data voltage output from drivers including the scan driver 130 and the data driver 140 and the first and second driving voltages EVDD and EVSS output from the power supply 180. Subpixels of the display panel 150 directly emit light.

For example, a single subpixel SP includes a pixel circuit PC including a switching transistor SW, a driving transistor, a storage capacitor, an organic LED, and the like.

The subpixel SP used in the organic light emitting display directly emits light and thus has a more complicated circuit configuration than that of the LCD. Furthermore, a compensation circuit for compensating for deterioration of the organic LED emitting light and the driving transistor for supplying a driving current to the organic LED is complicated. Accordingly, the pixel circuit PC included in the subpixel SP is illustrated in the form of a block.

Figure 5:
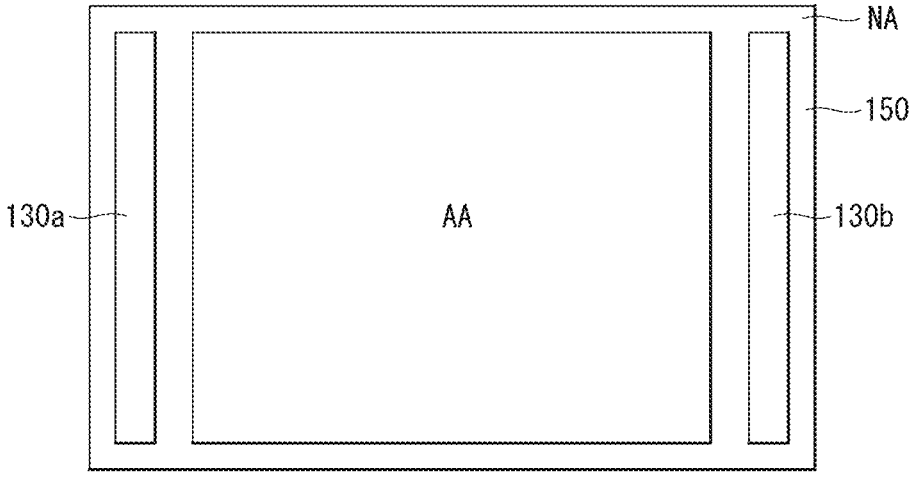
FIG. 5 is a diagram showing an arrangement example of a gate-in-panel scan driver.
Figure 5:
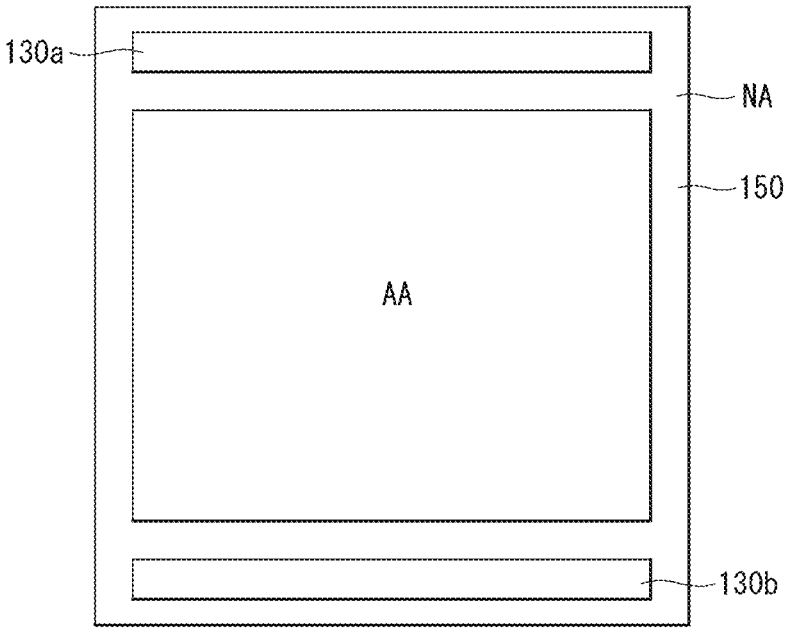
Figure 6:
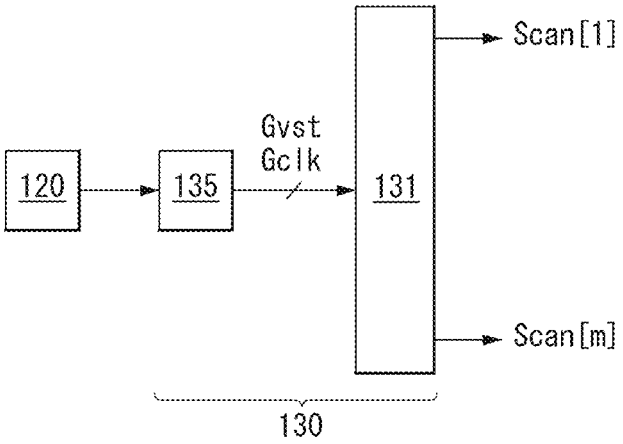
FIG. 6 illustrates a first configuration of a device related to the gate-in-panel scan driver.
Figure 7:
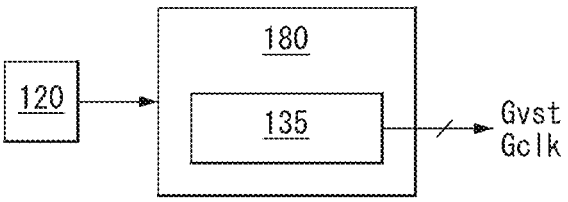
FIG. 7 illustrates a second configuration of a device related to the gate-in-panel scan driver.

FIG. 5 is a diagram showing an arrangement example of a gate-in-panel scan driver, FIG. 6 illustrates a first configuration of a device related to the gate-in-panel scan driver, and FIG. 7 illustrates a second configuration of a device related to the gate-in-panel scan driver.

As shown in FIG. 5, gate-in-panel scan drivers 130*a* and 130*b* are arranged in a non-display area NA of the display panel 150. The scan drivers 130*a* and 130*b* may be arranged in left and right non-display areas NA of the display panel 150, as shown in FIG. 5(*a*). Further, the scan drivers 130*a* and 130*b* may be arranged in upper and lower non-display areas NA of the display panel 150, as shown in FIG. 5(*b*).

Although an example in which the scan drivers 130*a* and 130*b* are arranged in a pair in the left and right non-display areas NA or the upper and lower non-display areas NA of a display area AA has been illustrated and described, the present invention is not limited thereto and only one scan driver may be disposed in the left, right, upper or lower non-display area NA.

As shown in FIG. 6, a gate-in-panel scan driver 130 may include a shift register circuit 131 (scan signal generator) and a level shifter 135 (clock signal and voltage generator). The level shifter 135 generates and outputs a plurality of clock signals Gclk and a start signal Gvst on the basis of signals output from the timing controller 120.

The plurality of clock signals Gclk may be generated and output in the form of K different phases (K being an integer equal to or greater than 2) such as 2, 4 or 8 phases.

The plurality of clock signals Gclk and the start signal Gvst are output through signal pads of the level shifter 135 and transmitted to the shift register circuit 131 through signal lines connected to the signal pads.

The shift register circuit 131 operates on the basis of the signals Gclk and Gvst output from the level shifter 135 and outputs scan signals Scan[1] to Scan[m] for turning on or off transistors formed in the display panel.

The shift register circuit 131 is formed in the form of a thin film on the display panel in a gate-in-panel manner. Accordingly, a part of the scan driver 130 formed on the display panel may be the shift register circuit 131 (that is, 130*a* and 130*b* in FIG. 5 correspond to 131).

Distinguished from the shift register circuit 131, the level shifter 135 is formed in the form of an IC. The level shifter 135 may be configured in the form of a separate IC, as shown in FIG. 6, or included in the power supply 180 or another device, as shown in FIG. 7.

In this manner, the shift register circuit 131 outputs the scan signals Scan[1] to Scan[m] on the basis of the plurality of clock signals Gclk and the start signal Gvst output from the level shifter 135.

However, when electromagnetic interference (EMI) is generated in the plurality of clock signals Gclk output from the level shifter 135, it is difficult to guarantee a smooth output state (characteristics, level, reliability and the like of scan signals) of the shift register circuit 131. Accordingly, the present invention proposes a method for improving or complementing problems that may be generated due to EMI as follows.

Figure 8:
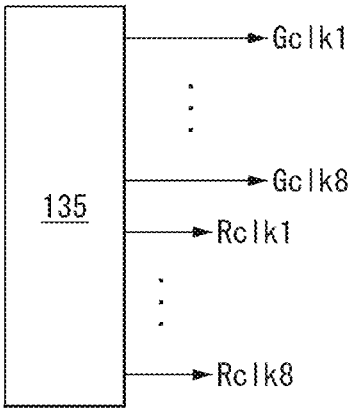
FIG. 8 is a diagram for describing a level shifter according to a first embodiment of the present invention and FIG. 9 is a waveform diagram of clock signals output from the level shifter shown in FIG. 8.
Figure 9:
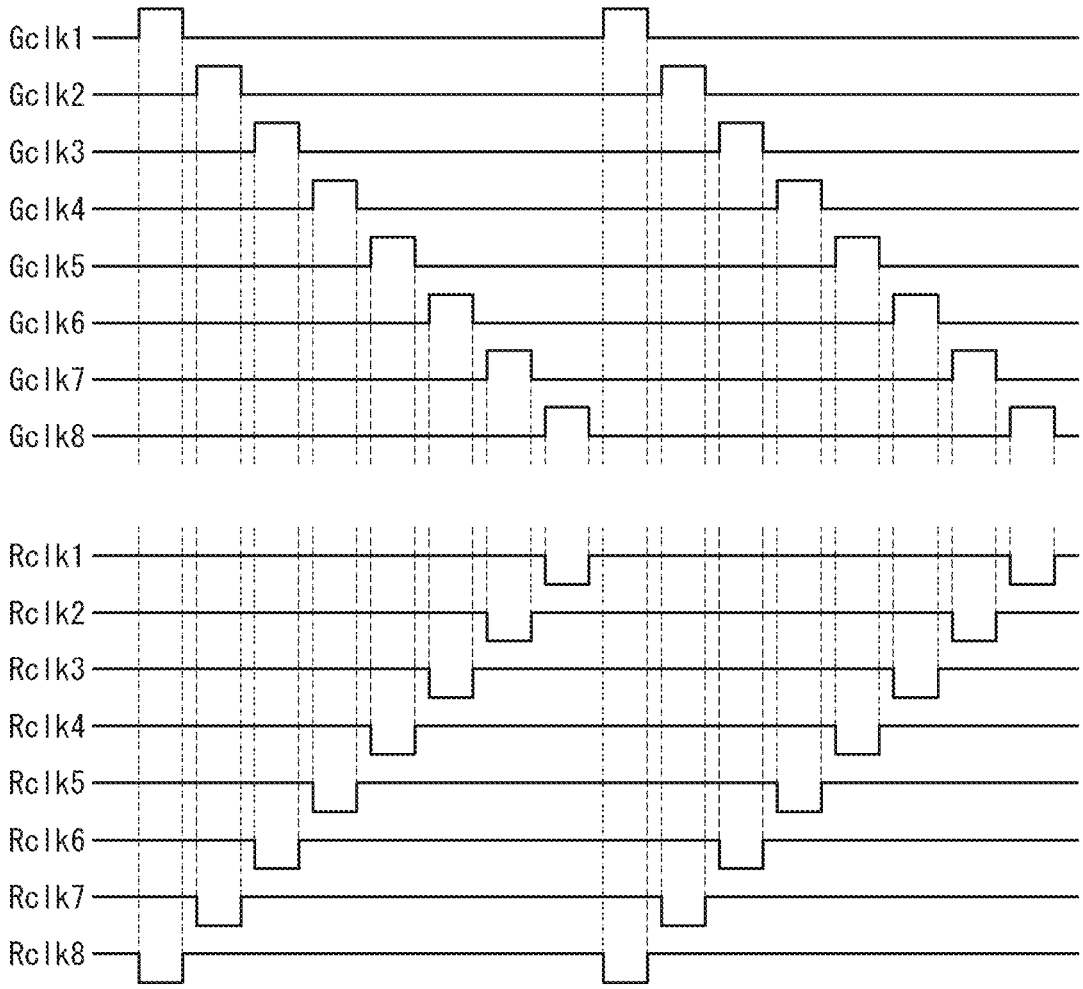

FIG. 8 is a diagram for describing a level shifter according to a first embodiment of the present invention and FIG. 9 is a waveform diagram of clock signals output from the level shifter shown in FIG. 8.

As shown in FIG. 8, the level shifter 135 according to the first embodiment includes clock signal lines through which first to eighth clock signals Gclk1 to Gclk8 are output and reverse clock signal lines through which first to eighth reverse clock signals Rclk1 to Rclk8 are output. However, the aforementioned operation of the level shifter 135 to output clock signals of 8 phases is merely an example and it can be ascertained from the above description that the level shifter 135 can output clock signals of at least 2 phases.

In the level shifter 135, the first to eighth clock signal lines (including clock signal pads) through which the first to eighth clock signals Gclk1 to Gclk 8 are output are sequentially adjacently arranged. In addition, the first to eighth reverse clock signal lines (including reverse clock signal pads) through which the first to eighth reverse clock signals Rclk1 to Rclk8 are output are sequentially adjacently arranged after the eighth clock signal line through which the eighth clock signal Gclk8 is output.

The first to eighth clock signal lines extend from first to eighth clock signal pads of the level shifter 135 and the first to eighth reverse clock signal lines extend from first to eighth reverse clock signal pads of the level shifter 135. Accordingly, a signal pad and a signal line are not discriminated from each other and they are collectively referred to as a signal line in the following for convenience of description, but the signal line includes the signal pad.

As shown in FIGS. 8 and 9, the level shifter 135 according to the first embodiment outputs the first to eighth clock signals Gclk1 to Gclk8 having a high logic state and a low logic state for a first period (for a first scan time). The first to eighth clock signals Gclk1 to Gclk8 have different times at which the high logic state is generated. The high logic states are sequentially generated in the first to eighth clock signals Gclk1 to Gclk8. The first to eighth clock signals Gclk1 to Gclk8 have high logic states at regular intervals which are sequentially generated without overlapping.

In addition, the level shifter 135 according to the first embodiment outputs the first to eighth reverse clock signals Rclk1 to Rclk8 having the low logic state and the high logic state for the first period (for the first scan time). The first to eighth reverse clock signals Rclk1 to Rclk8 have different times at which the low logic state is generated. The low logic state is generated in reverse order in the first to eighth reverse clock signals Rclk1 to Rclk8. The first to eighth reverse clock signals Rclk1 to Rclk8 have low logic states at regular intervals which are generated in reverse order without overlapping.

Consequently, the first clock signal Gclk1 has a reverse phase relationship (relationship in which reverse phases are formed) with the eighth reverse clock signal Rclk8, the second clock signal Gclk2 has a reverse phase relationship with the seventh reverse clock signal Rclk7, the third clock signal Gclk3 has a reverse phase relationship with the sixth reverse clock signal Rclk6, and the fourth clock signal Gclk4 has a reverse phase relationship with the fifth reverse clock signal Rclk5.

Figure 10:
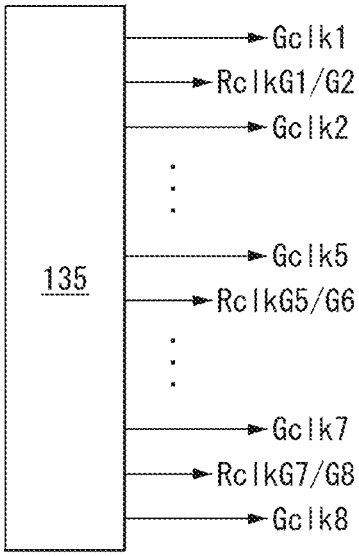
FIG. 10 is a diagram for describing a level shifter according to a second embodiment of the present invention and FIG. 11 is a waveform diagram of clock signals output from the level shifter shown in FIG. 10.
Figure 11:
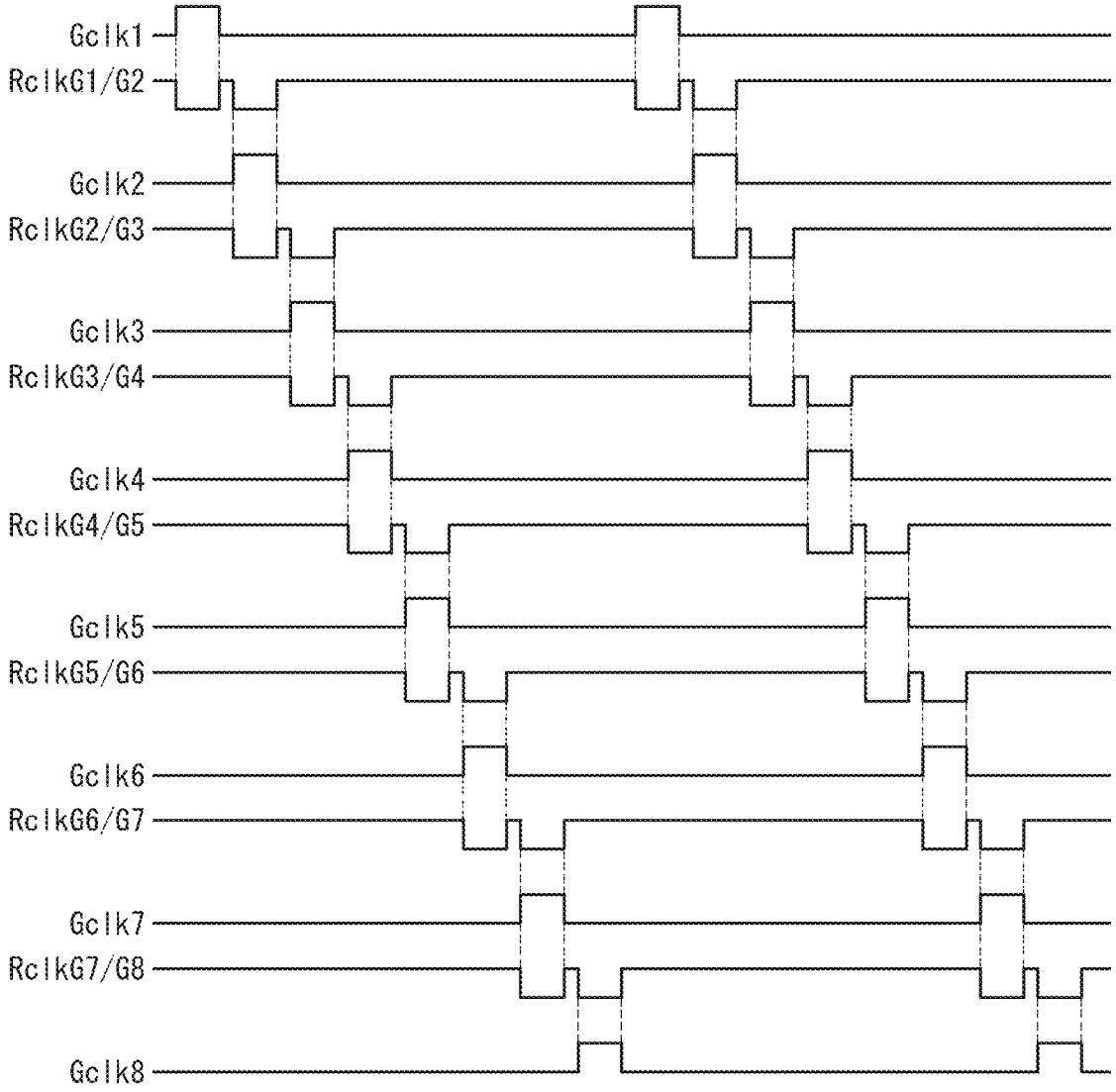

FIG. 10 is a diagram for describing a level shifter according to a second embodiment of the present invention and FIG. 11 is a waveform diagram of clock signals output from the level shifter shown in FIG. 10.

As shown in FIG. 10, the level shifter 135 according to the second embodiment includes clock signal lines through which first to eighth clock signals Gclk1 to Gclk8 are output and reverse clock signal lines through which first to seventh reverse clock signals RclkG1/G2 to RclkG7/G8 are output. However, the aforementioned operation of the level shifter 135 to output clock signals of 8 phases is merely an example and it can be ascertained from the above description that the level shifter 135 can output clock signals of at least 2 phases.

In the level shifter 135, the first to eighth clock signal lines through which the first to eighth clock signals Gclk1 to Gclk8 are output are sequentially arranged every other line. The first to seventh reverse clock signal lines through which the first to seventh reverse clock signals RclkG1G2 to RclkG7/G8 are output are sequentially arranged every other line such that one reverse clock signal line is positioned for two clock signal lines. That is, the first to eighth clock signal lines and the first to seventh reverse clock signal lines are alternately arranged.

Consequently, the level shifter 135 according to the second embodiment has signal lines arranged in the order of the first clock signal line, the first reverse clock signal line, the second clock signal line, the second reverse clock signal line, the third clock signal line, the third reverse clock signal line, the fourth clock signal line, the fourth reverse clock signal line, the fifth clock signal line, the fifth reverse clock signal line, the sixth clock signal line, the sixth reverse clock signal line, the seventh clock signal line, the seventh reverse clock signal line, and the eighth clock signal line.

As shown in FIGS. 10 and 11, the level shifter 135 according to the second embodiment outputs the first to eighth clock signals Gclk1 to Gclk8 having a high logic state and a low logic state for a first period (for a first scan time). The first to eighth clock signals Gclk1 to Gclk8 have different times at which the high logic state is generated. The high logic states are sequentially generated in the first to eighth clock signals Gclk1 to Gclk8. The first to eighth clock signals Gclk1 to Gclk8 have high logic states at regular intervals which are sequentially generated without overlapping.

In addition, the level shifter 135 according to the second embodiment outputs the first to seventh reverse clock signals RclkG1/G2 to RclkG7/G8 having the low logic state and the high logic state for the first period (for the first scan time). In the first to seventh reverse clock signals RclkG1/G2 to RclkG7/G8, the low logic state is generated twice at regular intervals. The first low logic state is generated at different times in the first to seventh reverse clock signals RclkG1/G2 to RclkG7/G8 and the second low logic state is generated at the same time as the first low logic state of the next reverse clock signal. The second low logic states of the first to seventh reverse clock signals RclkG1/G2 to RclkG7/G8 are sequentially generated at regular intervals.

In addition, the second low logic state of a reverse clock signal overlaps with the first low logic state of the next reverse clock signal. Each of the first to seventh reverse clock signals RclkG1/G2 to RclkG7/G8 is obtained by reversing the high logic states of two neighboring clock signal lines, which are sequentially generated at regular intervals.

Consequently, the first reverse clock signal RclkG1/G2 has a reverse phase relationship with the first and second clock signals Gclk1 and Gclk2 and thus has two low logic states obtained by reversing the high logic states of the first and second clock signals Gclk1 and Gclk2. In addition, the second reverse clock signal RclkG2/G3 has a reverse phase relationship with the second and third clock signals Gclk2 and Gclk3 and thus has two low logic states obtained by reversing the high logic states of the second and third clock signals Gclk2 and Gclk3.

Further, the third reverse clock signal RclkG3/G4 has a reverse phase relationship with the third and fourth clock signals Gclk3 and Gclk4 and thus has two low logic states obtained by reversing the high logic states of the third and fourth clock signals Gclk3 and Gclk4. The fourth reverse clock signal RclkG4/G5 has a reverse phase relationship with the fourth and fifth clock signals Gclk4 and Gclk5 and thus has two low logic states obtained by reversing the high logic states of the fourth and fifth clock signals Gclk4 and Gclk5.

Further, the fifth reverse clock signal RclkG5/G6 has a reverse phase relationship with the fifth and sixth clock signals Gclk5 and Gclk6 and thus has two low logic states obtained by reversing the high logic states of the fifth and sixth clock signals Gclk5 and Gclk6. The sixth reverse clock signal RclkG6/G7 has a reverse phase relationship with the sixth and seventh clock signals Gclk6 and Gclk7 and thus has two low logic states obtained by reversing the high logic states of the sixth and seventh clock signals Gclk6 and Gclk7. The seventh reverse clock signal RclkG7/G8 has a reverse phase relationship with the seventh and eighth clock signals Gclk7 and Gclk8 and thus has two low logic states obtained by reversing the high logic states of the seventh and eighth clock signals Gclk7 and Gclk8.

Figure 12:
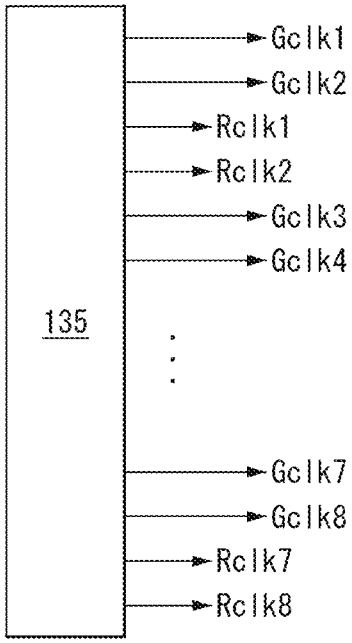
FIG. 12 is a diagram for describing a level shifter according to a third embodiment of the present invention and FIG. 13 is a waveform diagram of clock signals output from the level shifter shown in FIG. 12.
Figure 13:
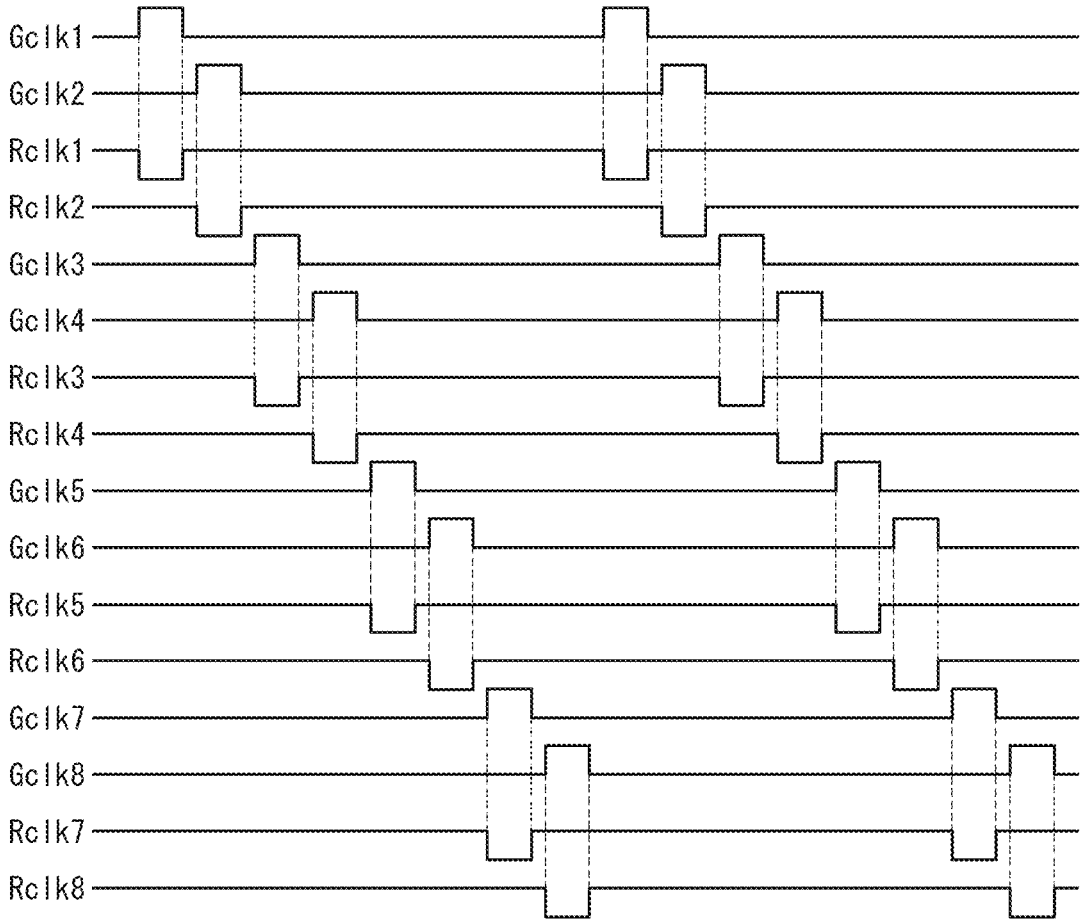

FIG. 12 is a diagram for describing a level shifter according to a third embodiment of the present invention and FIG. 13 is a waveform diagram of clock signals output from the level shifter shown in FIG. 12.

As shown in FIG. 12, the level shifter 135 according to the third embodiment includes clock signal lines through which first to eighth clock signals Gclk1 to Gclk8 are output and reverse clock signal lines through which first to seventh reverse clock signals Rclk1 to Rclk8 are output. However, the aforementioned operation of the level shifter 135 to output clock signals of 8 phases is merely an example and it can be ascertained from the above description that the level shifter 135 can output clock signals of at least 2 phases.

In the level shifter 135, the first to eighth clock signal lines through which the first to eighth clock signals Gclk1 to Gclk8 are output are sequentially arranged in pairs, and the first to seventh reverse clock signal lines through which the first to eighth reverse clock signals Rclk1 to Rclk8 are output are sequentially arranged in pairs between neighboring clock signal line pairs.

As shown in FIGS. 12 and 13, the level shifter 135 according to the third embodiment outputs the first to eighth clock signals Gclk1 to Gclk8 having a high logic state and a low logic state for a first period (for a first scan time). The first to eighth clock signals Gclk1 to Gclk8 have different times at which two high logic states are generated. The two high logic states are sequentially generated in the first to eighth clock signals Gclk1 to Gclk8. The first to eighth clock signals Gclk1 to Gclk8 have the two high logic states at regular intervals which are sequentially generated without overlapping.

In addition, the level shifter 135 according to the third embodiment outputs the first to eighth reverse clock signals Rclk1 to Rclk8 having the low logic state and the high logic state for the first period (for the first scan time). In the first to eighth reverse clock signals Rclk1 to Rclk8, the low logic state is generated twice at different times. In the first to eighth reverse clock signals Rclk1 to Rclk8, the two low logic states are sequentially generated. The first to eighth reverse clock signals Rclk1 to Rclk8 have the two low logic states at regular intervals which are sequentially generated without overlapping.

Consequently, the first clock signal Gclk1 has a reverse phase relationship with the first reverse clock signal Rclk1, the second clock signal Gclk2 has a reverse phase relationship with the second reverse clock signal Rclk2, the third clock signal Gclk3 has a reverse phase relationship with the third reverse clock signal Rclk3, the fourth clock signal Gclk4 has a reverse phase relationship with the fourth reverse clock signal Rclk4, the fifth clock signal Gclk5 has a reverse phase relationship with the fifth reverse clock signal Rclk5, the sixth clock signal Gclk6 has a reverse phase relationship with the sixth reverse clock signal Rclk6, the seventh clock signal Gclk7 has a reverse phase relationship with the seventh reverse clock signal Rclk7, and the eighth clock signal Gclk8 has a reverse phase relationship with the eighth reverse clock signal Rclk8.

Figure 14:
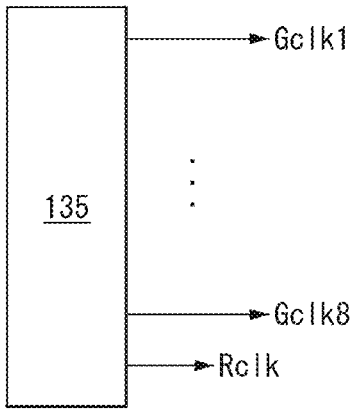
FIG. 14 is a diagram for describing a level shifter according to a fourth embodiment of the present invention and FIG. 15 is a waveform diagram of clock signals output from the level shifter shown in FIG. 14.
Figure 15:
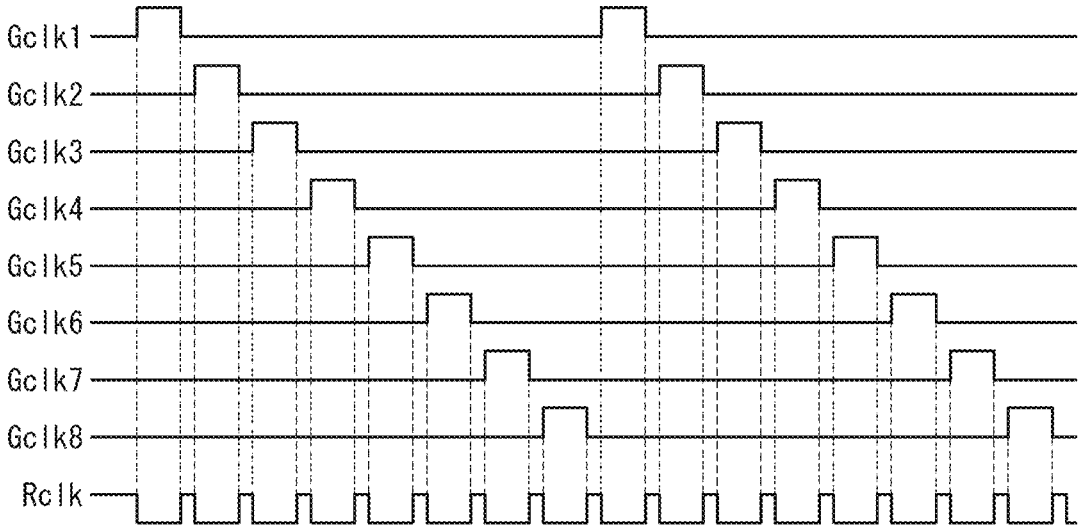

FIG. 14 is a diagram for describing a level shifter according to a fourth embodiment of the present invention and FIG. 15 is a waveform diagram of clock signals output from the level shifter shown in FIG. 14.

As shown in FIG. 14, the level shifter 135 according to the fourth embodiment includes clock signal lines through which first to eighth clock signals Gclk1 to Gclk8 are output and a reverse clock signal line through which a reverse clock signal Rclk is output. However, the aforementioned operation of the level shifter 135 to output clock signals of 8 phases is merely an example and it can be ascertained from the above description that the level shifter 135 can output clock signals of at least 2 phases.

In the level shifter 135, the first to eighth clock signal lines through which the first to eighth clock signals Gclk1 to Gclk8 are output are sequentially adjacently arranged. In addition, the reverse clock signal line through which the reverse clock signal Rclk is output is arranged in proximity to the eighth clock signal line through which the eighth clock signal Gclk8 is output.

As shown in FIGS. 14 and 15, the level shifter 135 according to the fourth embodiment outputs the first to eighth clock signals Gclk1 to Gclk8 having a high logic state and a low logic state for a first period (for a first scan time). The first to eighth clock signals Gclk1 to Gclk8 have different times at which the high logic state is generated twice. The two high logic states are sequentially generated in the first to eighth clock signals Gclk1 to Gclk8. In the first to eighth clock signals Gclk1 to Gclk8, the two high logic states are sequentially generated at regular intervals without overlapping, and the second high logic state of the first clock signal is generated after the first high logic state of the last clock signal.

In addition, the level shifter 135 according to the fourth embodiment outputs the reverse clock signal Rclk having a plurality of low logic states and high logic states for the first period (for the first scan time). The plurality of low logic states is generated at different times in the reverse clock signal Rclk. The low logic states of the reverse clock signal Rclk correspond to the high logic states included in the first to eighth clock signals Gclk1 to Gclk8. The reverse clock signal Rclk includes a total of 16 low logic states corresponding to the number of high logic states included in the first to eighth clock signals Gclk1 to Gclk8.

Consequently, the reverse clock signal Rclk has low logic states having a reverse phase relationship with the high logic states included in the first to eighth clock signals Gclk1 to Gclk8. In other words, the number of low logic states included in the reverse clock signal Rclk equals the number of high logic states included in the first to eighth clock signals Gclk1 to Gclk8.

Figure 16:
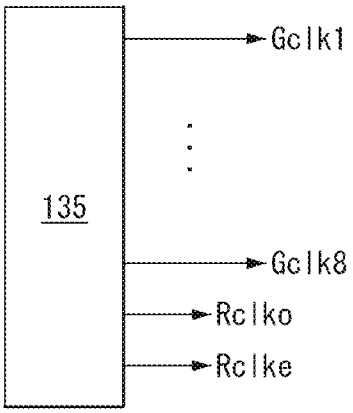
FIG. 16 is a diagram for describing a level shifter according to a fifth embodiment of the present invention and FIG. 17 is a waveform diagram of clock signals output from the level shifter shown in FIG. 16.
Figure 17:
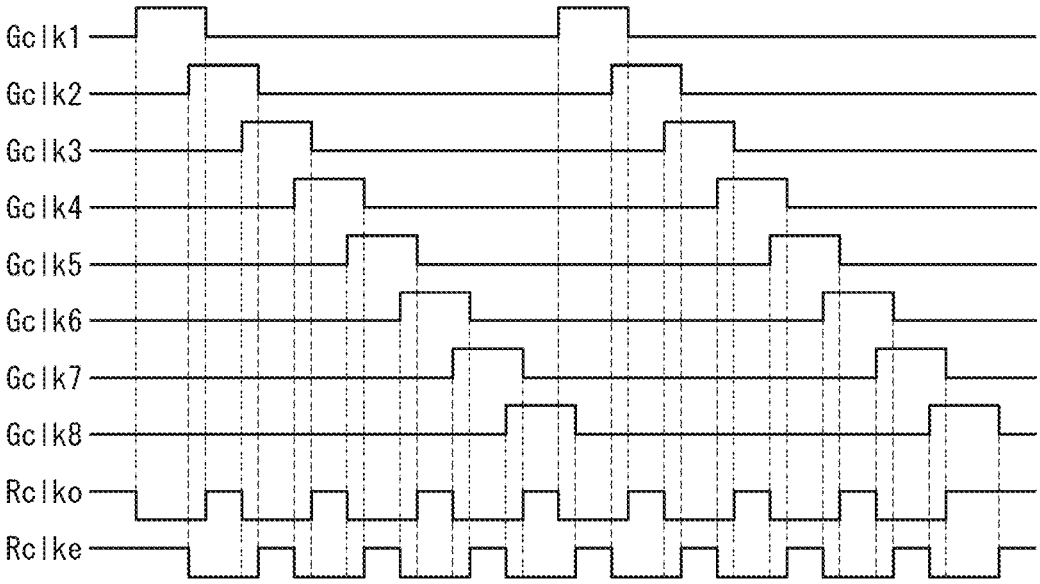

FIG. 16 is a diagram for describing a level shifter according to a fifth embodiment of the present invention and FIG. 17 is a waveform diagram of clock signals output from the level shifter shown in FIG. 16.

As shown in FIG. 16, the level shifter 135 according to the fifth embodiment includes clock signal lines through which first to eighth clock signals Gclk1 to Gclk8 are output and reverse clock signal lines through which first and second reverse clock signals Rclko and Rclke are output. However, the aforementioned operation of the level shifter 135 to output clock signals of 8 phases is merely an example and it can be ascertained from the above description that the level shifter 135 can output clock signals of at least 2 phases.

In the level shifter 135, the first to eighth clock signal lines through which the first to eighth clock signals Gclk1 to Gclk8 are output are sequentially adjacently arranged. In addition, the reverse clock signal lines through which the first and second reverse clock signals Rclko and Rclke are output are sequentially arranged in proximity to the eighth clock signal line through which the eighth clock signal Gclk8 is output.

As shown in FIGS. 16 and 17, the level shifter 135 according to the fifth embodiment outputs the first to eighth clock signals Gclk1 to Gclk8 having a high logic state and a low logic state for a first period (for a first scan time). In the first to eighth clock signals Gclk1 to Gclk8, the high logic state is generated twice and high logic durations partially overlap.

In the first to eighth clock signals Gclk1 to Gclk8, the two high logic states are sequentially generated and high logic durations partially overlap. In the first to eighth clock signals Gclk1 to Gclk8, the high logic state is generated twice such that the high logic states of two neighboring clock signals overlap and the first high logic state of the last clock signal overlaps the second high logic state of the first clock signal.

In addition, the level shifter 135 according to the fifth embodiment outputs the first and second reverse clock signals Rclko and Rclk3 having a plurality of low logic states and high logic states for the first period (for the first scan time). In the first reverse clock signal Rclko, the plurality of low logic states is generated at the same time as the high logic states of the odd-numbered clock signals. The low logic states of the first reverse clock signal Rclko correspond to the high logic states included in the first, third, fifth and seventh clock signals Gclk1, Gclk3, Gclk5 and Gclk7. In the second reverse clock signal Rclke, the plurality of low logic states is generated at the same time as the high logic states of the even-numbered clock signals. The low logic states of the second reverse clock signal Rclke correspond to the high logic states included in the second, fourth, sixth and eighth clock signals Gclk2, Gclk4, Gclk6 and Gclk8.

The first reverse clock signal Rclko has a total of eight low logic states corresponding to the number of high logic states included in the first, third, fifth and seventh clock signals Gclk1, Gclk3, Gclk5 and Gclk7. The second reverse clock signal Rclke has a total of eight low logic states corresponding to the number of high logic states included in the second, fourth, sixth and eighth clock signals Gclk2, Gclk4, Gclk6 and Gclk8.

Consequently, the first reverse clock signal Rclko has low logic states having a reverse phase relationship with the high logic states included in the first, third, fifth and seventh clock signals Gclk1, Gclk3, Gclk5 and Gclk7. In other words, the number of low logic states included in the first reverse clock signal Rclko is half the number of high logic states included in the first, third, fifth and seventh clock signals Gclk1, Gclk3, Gclk5 and Gclk7. The second reverse clock signal Rclke has low logic states having a reverse phase relationship with the high logic states included in the second, fourth, sixth and eighth clock signals Gclk2, Gclk4, Gclk6 and Gclk8. In other words, the number of low logic states included in the second reverse clock signal Rclke is half the number of high logic states included in the second, fourth, sixth and eighth clock signals Gclk2, Gclk4, Gclk6 and Gclk8.

Figure 18:
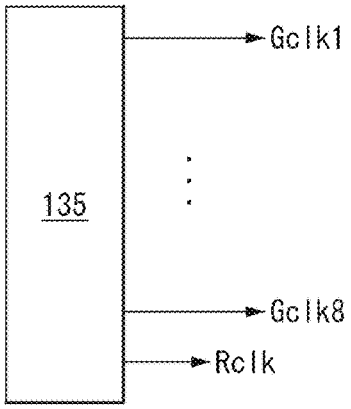
FIG. 18 is a diagram for describing a level shifter according to a sixth embodiment of the present invention and FIG. 19 is a waveform diagram of clock signals output from the level shifter shown in FIG. 18.
Figure 19:
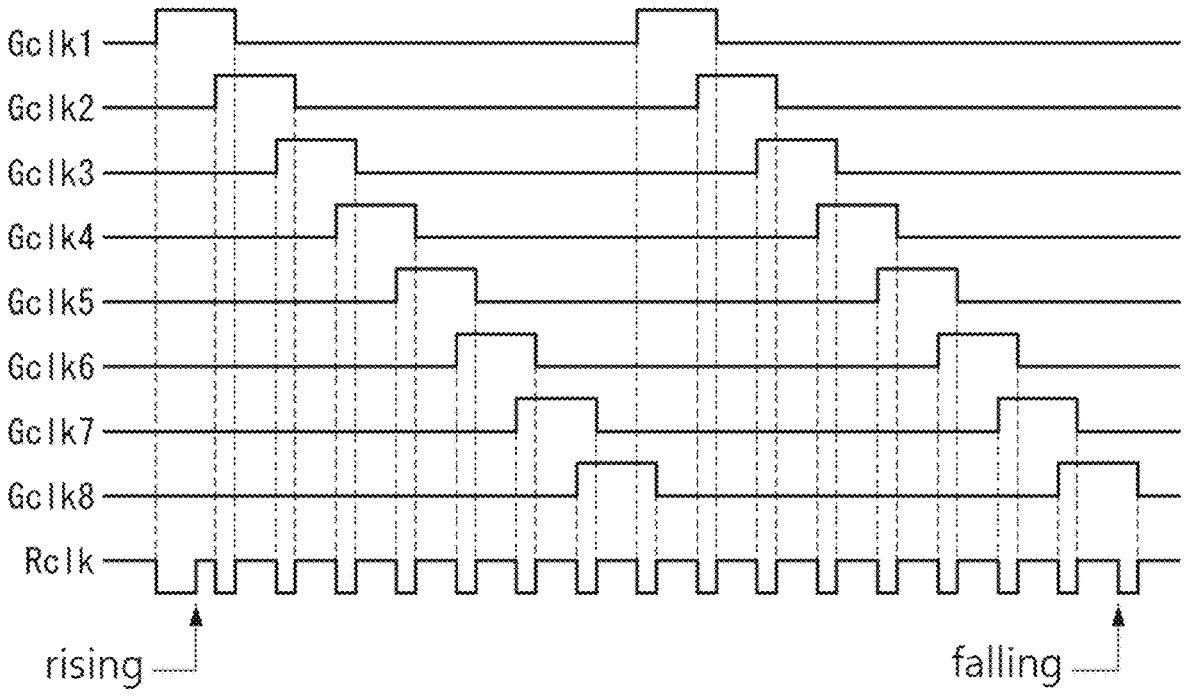

FIG. 18 is a diagram for describing a level shifter according to a sixth embodiment of the present invention and FIG. 19 is a waveform diagram of clock signals output from the level shifter shown in FIG. 18.

As shown in FIG. 18, the level shifter 135 according to the sixth embodiment includes clock signal lines through which first to eighth clock signals Gclk1 to Gclk8 are output and a reverse clock signal line through which a reverse clock signal Rclk is output. However, the aforementioned operation of the level shifter 135 to output clock signals of 8 phases is merely an example and it can be ascertained from the above description that the level shifter 135 can output clock signals of at least 2 phases.

In the level shifter 135, the first to eighth clock signal lines through which the first to eighth clock signals Gclk1 to Gclk8 are output are sequentially adjacently arranged. In addition, the reverse clock signal line through which the reverse clock signal is output is arranged in proximity to the eighth clock signal line through which the eighth clock signal Gclk8 is output.

As shown in FIGS. 18 and 19, the level shifter 135 according to the sixth embodiment outputs the first to eighth clock signals Gclk1 to Gclk8 having a high logic state and a low logic state for a first period (for a first scan time). In the first to eighth clock signals Gclk1 to Gclk8, the high logic state is generated twice and high logic durations partially overlap. In the first to eighth clock signals Gclk1 to Gclk8, the two high logic states are sequentially generated and high logic durations partially overlap. In the first to eighth clock signals Gclk1 to Gclk8, the high logic state is generated twice such that the high logic states of two neighboring clock signals overlap and the first high logic state of the last clock signal overlaps the second high logic state of the first clock signal.

In addition, the level shifter 135 according to the sixth embodiment outputs the reverse clock signal Rclk having a plurality of low logic states and high logic states for the first period (for the first scan time). In the reverse clock signal Rclk, the plurality of low logic states is generated at different times. The low logic states and high logic states of the reverse clock signal are toggled in response to the high logic states and low logic states included in the first to eighth clock signals Gclk1 to Gclk8. In addition, the reverse clock signal Rclk includes arbitrary rising/falling points in times at the beginning and the end thereof. The reverse clock signal Rclk has at least 16 low logic states±a (a being arbitrary rising/falling point in time) corresponding to the number of high logic states included in the first to eighth clock signals Gclk1 to Gclk8.

Consequently, the reverse clock signal Rclk has a reverse phase relationship (asymmetrical reverse phase relationship) with high logic states and low logic states included in the first to eighth clock signals Gclk1 to Gclk8. In other words, the number of low logic states included in the reverse clock signal Rclk is similar to the number of high logic states included in the first to eighth clock signals Gclk1 to Gclk8.

As described above through the first to sixth embodiments of the present invention, when the level shifter 135 outputs reverse clock signals having phases reverse to those of clock signals, a reverse signal component having phases reverse to those of the original signal causes offset or compensation of a specific frequency band signal and thus problems caused by EMI can be solved or complemented.

Meanwhile, although the present invention has been described using the first to sixth embodiments, one or more embodiments may be combined in consideration of the configurations and forms of clock signals and the configuration and size of the display device.

FIGS. 20 to 23 are diagrams for describing a level shifter according to a seventh embodiment of the present invention.

As shown in FIGS. 20 to 23, the level shifter 135 according to the seventh embodiment includes clock signal lines and reverse clock signal lines. The clock signal lines and the reverse clock signal lines may be arranged in consideration of the configurations and forms of clock signals and the configuration and size of a display device in order to minimize problems caused by EMI.

Figure 20:
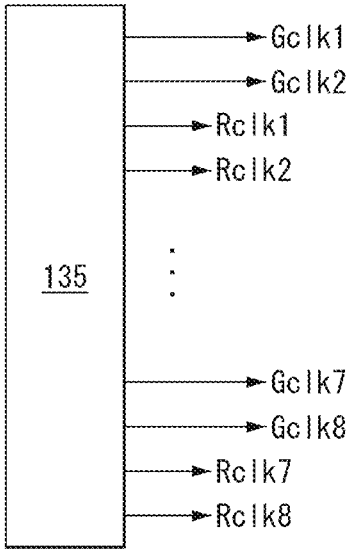
FIGS. 20 to 23 are diagrams for describing a level shifter according to a seventh embodiment of the present invention.

As shown in FIG. 20, the level shifter 135 may include clock signal lines through which first to eighth clock signals Gclk1 to Gclk8 are output and reverse clock signal lines through which first to eighth reverse clock signals Rclk1 to Rclk8 are output. FIG. 20 shows an example in which the level shifter 135 includes 8 clock signal lines and 8 reverse clock signal lines (the number of clock signal lines equals the number of reverse signal lines). When the level shifter 135 is configured as shown in FIG. 20, the clock signal lines may be paired, the reverse clock signal lines may be paired, and the clock signal line pairs and the reverse clock signal line pairs may be alternately arranged.

Figure 21:
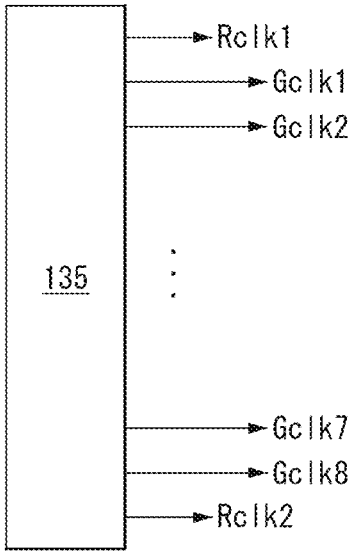

As shown in FIG. 21, the level shifter 135 may include clock signal lines through which first to eighth clock signals Gclk1 to Gclk8 are output and reverse clock signal lines through which first and second reverse clock signals Rclk1 and Rclk2 are output. FIG. 21 shows an example in which the level shifter 135 includes 8 clock signal lines and 2 reverse clock signal lines (the number of clock signal lines differs from the number of reverse signal lines). When the level shifter 135 is configured as shown in FIG. 21, the 2 reverse clock signal lines may be arranged in proximity to the outmost clock signal lines. For example, the 2 reverse clock signal lines may be arranged in proximity to the first clock signal line and the last clock signal line.

Figure 22:
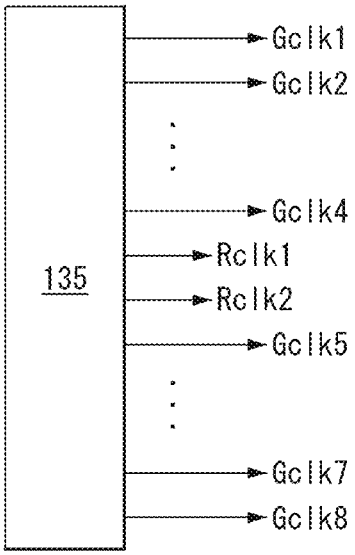

As shown in FIG. 22, the level shifter 135 may include clock signal lines through which first to eighth clock signals Gclk1 to Gclk8 are output and reverse clock signal lines through which first and second reverse clock signals Rclk1 and Rclk2 are output. FIG. 22 shows an example in which the level shifter 135 includes 8 clock signal lines and 2 reverse clock signal lines (the number of clock signal lines differs from the number of reverse signal lines). When the level shifter 135 is configured as shown in FIG. 22, the 2 reverse clock signal lines may be arranged in the middle of the clock signal lines. For example, the 2 reverse clock signal lines may be arranged between the fourth and fifth clock signal lines.

Figure 23:
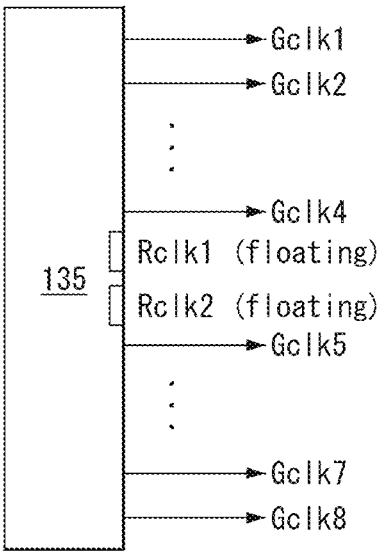

As shown in FIG. 23, the level shifter 135 may include clock signal lines through which first to eighth clock signals Gclk1 to Gclk8 are output and reverse clock signal pads through which first and second reverse clock signals Rclk1 and Rclk2 are output. FIG. 23 shows an example in which the level shifter 135 includes 8 clock signal lines and 2 reverse clock signal pads (the number of clock signal lines differs from the number of reverse signal pads). When the level shifter 135 is configured as shown in FIG. 23, the 2 reverse clock signal pads may be arranged in the middle of the clock signal lines. For example, the 2 reverse clock signal pads may be arranged between the fourth and fifth clock signal lines. In the example of FIG. 23, reverse clock signal lines electrically connected to the level shifter 135 are not wired and only the pads are provided. That is, the first and second reverse clock signal pads are electrically floated without being connected to the lines.

In the above-described seventh embodiment of the present invention, arrangements of reverse clock signal lines and reverse clock signal pads have been separately described in consideration of the configurations and forms of clock signals and the configuration and size of the display device. However, one or more of the first to seventh embodiments may be combined in consideration of the configuration and form of clock signals and the configuration and size of the display device.

FIGS. 24 to 30 are diagrams for describing methods of forming a clock signal and a reverse clock signal according to an eighth embodiment of the present invention.

As shown in FIGS. 24 to 30, a level shifter according to the eighth embodiment can generate a clock signal and a reverse clock signal in various forms in consideration of the configurations and forms of clock signals and the configuration and size of a display device in order to minimize problems caused by EMI.

Figure 24:
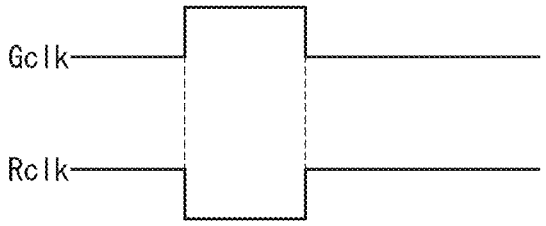
FIGS. 24 to 30 are diagrams for describing methods of forming a clock signal and a reverse clock signal according to an eighth embodiment of the present invention.

As shown in FIG. 24, a clock signal Gclk and a reverse clock signal Rclk may have a reverse phase relationship therebetween in which a pulse generation time and an end time of the clock signal Gclk are identical to those of the reverse clock signal Rclk (a state in which the pulse generation time and end time of the clock signal Gclk are synchronized with those of the reverse clock signal Rclk) such that the width of a high logic pulse is identical to the width of a low logic pulse.

Figure 25:
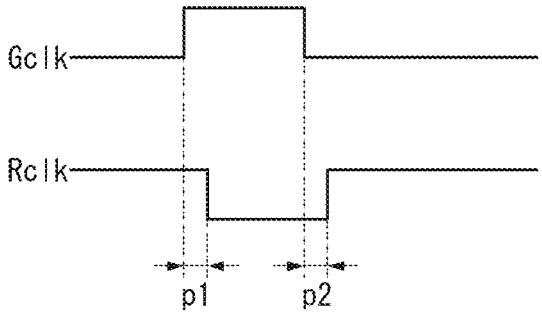

As shown in FIG. 25, the clock signal Gclk and the reverse clock signal Rclk may have an asynchronous reverse phase relationship therebetween in which the width of the high logic pulse is identical to the width of the low logic pulse but a pulse generation time and an end time of the reverse clock signal Rclk are delayed (refer to p1 and p2) (a state in which the pulse generation time and end time of the clock signal Gclk are not synchronized with those of the reverse clock signal Rclk).

Figure 26:
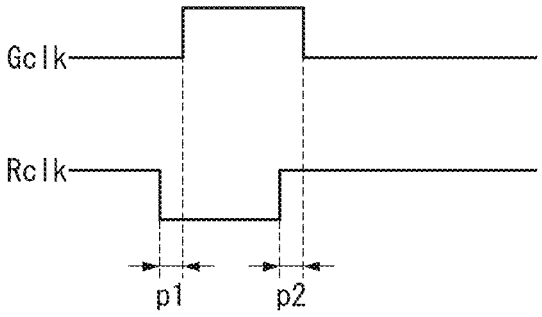

As shown in FIG. 26, the clock signal Gclk and the reverse clock signal Rclk may have an asynchronous reverse phase relationship therebetween in which the width of the high logic pulse is identical to the width of the low logic pulse but a pulse generation time and an end time of the reverse clock signal Rclk are advanced (refer to p1 and p2) (a state in which the pulse generation time and the end time of the clock signal Gclk are not synchronized with those of the reverse clock signal Rclk).

Figure 27:
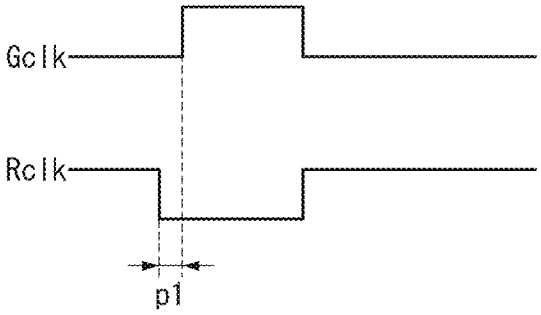

As shown in FIG. 27, the clock signal Gclk and the reverse clock signal Rclk may have an asynchronous reverse phase relationship therebetween in which only the pulse generation time of the reverse clock signal Rclk is advanced (refer to p1) such that the width of the high logic pulse differs from the width of the low logic pulse (a state in which only the pulse end times thereof are synchronized with each other).

Figure 28:
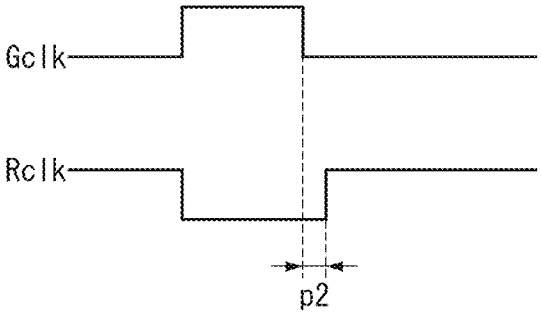

As shown in FIG. 28, the clock signal Gclk and the reverse clock signal Rclk may have an asynchronous reverse phase relationship therebetween in which only the pulse end time of the reverse clock signal Rclk is delayed (refer to p2) such that the width of the high logic pulse differs from the width of the low logic pulse (a state in which only the pulse generation times thereof are synchronized with each other).

Figure 29:
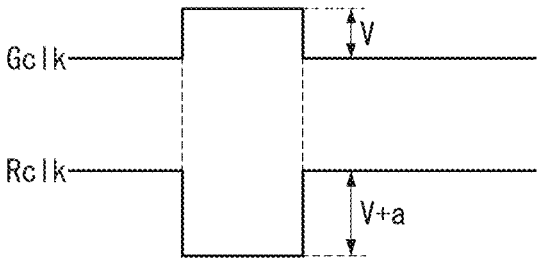

As shown in FIG. 29, the clock signal Gclk and the reverse clock signal Rclk may have a reverse phase relationship therebetween in which the pulse generation time and the end time of the clock signal Gclk are identical to those of the reverse clock signal Rclk (a state in which the pulse generation time and the end time of the clock signal Gclk are synchronized with those of the reverse clock signal Rclk) such that the width of a high logic pulse is identical to the width of a low logic pulse. However, the voltage level of the low logic pulse included in the reverse clock signal Rclk may be higher than that of the high logic pulse included in the clock signal Gclk (the level of the clock signal is different from that of the reverse clock signal) (refer to the relationship between V of Gclk and V+a of Rclk).

Figure 30:
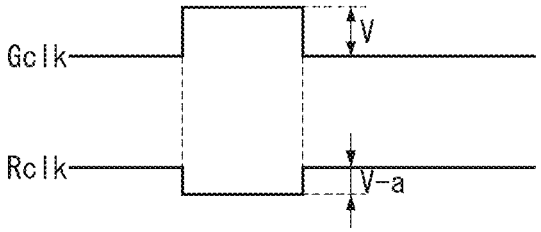

As shown in FIG. 30, the clock signal Gclk and the reverse clock signal Rclk may have a reverse phase relationship therebetween in which the pulse generation time and the end time of the clock signal Gclk are identical to those of the reverse clock signal Rclk (a state in which the pulse generation time and the end time of the clock signal Gclk are synchronized with those of the reverse clock signal Rclk) such that the width of a high logic pulse is identical to the width of a low logic pulse. However, the voltage level of the low logic pulse included in the reverse clock signal Rclk may be lower than that of the high logic pulse included in the clock signal Gclk (the level of the clock signal is different from that of the reverse clock signal) (refer to the relationship between V of Gclk and V−a of Rclk).

Methods of forming a clock signal and a reverse clock signal in configuration of the configurations and forms of clock signals and the configurations and size of the display device have been described in the eighth embodiment of the present invention. However, a reverse clock signal may be formed by combining one or more of the methods of FIGS. 24 to 30.

FIGS. 31 to 35 are diagrams for briefly describing examples of arrangement and wiring of signal lines connected to a level shifter according to a ninth embodiment of the present invention.

Figure 31:
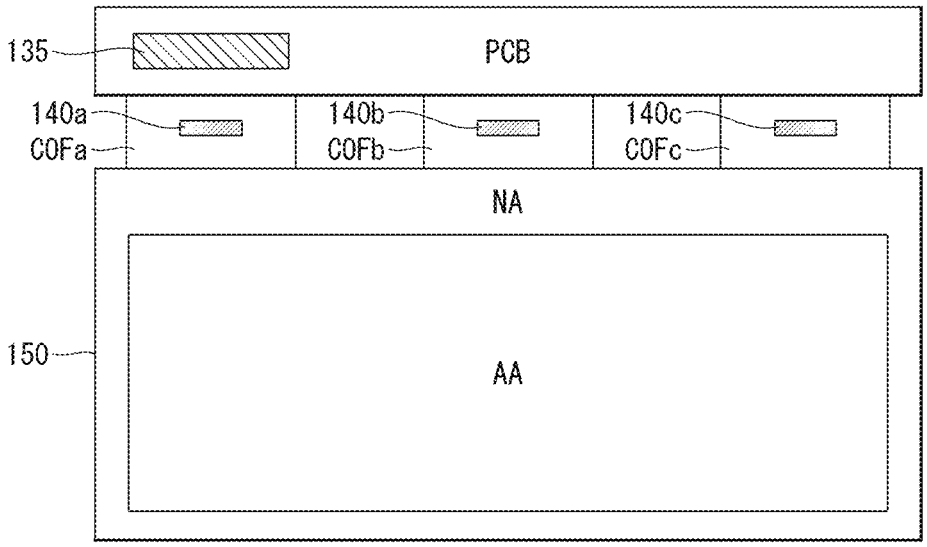
FIGS. 31 to 35 are diagrams for briefly describing examples of arrangement and wiring of signal lines connected to a level shifter according to a ninth embodiment of the present invention.

As shown in FIG. 31, a display device may include a display panel 150, flexible films COFa to COFc, a shift register circuit 131, data drivers 140*a* to 140*c*, an external substrate PCB, a level shifter 135, and the like. However, this is merely an example and the present invention is not limited thereto.

The display panel 150 may include a display area AA in which an image is displayed and a non-display area NA in which an image is not displayed. The shift register circuit 131 may be arranged in the non-display area NA on one side of the display panel 150. The data drivers 140*a* to 140*c* may be respectively mounted on the flexible films COFa to COFc. One side of the flexible films COFa to COFc may be attached to the non-display area NA of the display panel 150 and the other side may be attached to the external substrate PCB. The level shifter 135 may be disposed on a part of the external substrate PCB in proximity to the first flexible film COFa.

Figure 32:
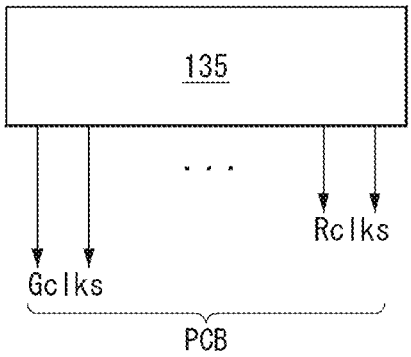

When the display device is configured as shown in FIG. 31, clock signal lines GCLKs and reverse clock signal lines RCLKs of the level shifter 135 may be wired such that they are arranged on the external substrate PCB, as shown in FIG. 32.

Figure 33:
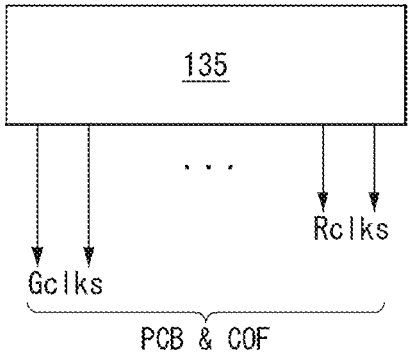

When the display device is configured as shown in FIG. 31, the clock signal lines GCLKs and the reverse clock signal lines RCLKs of the level shifter 135 may be wired such that they are arranged on the external substrate PCB and a flexible film COF, as shown in FIG. 33. The flexible film COF may be one or more selected from the first to third flexible films COFa to COFc.

Figure 34:
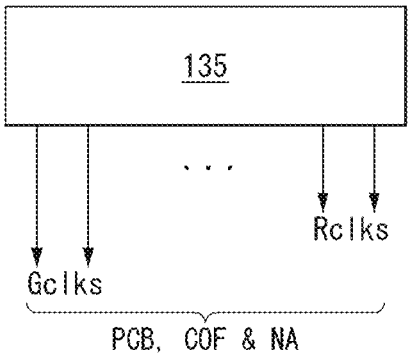

When the display device is configured as shown in FIG. 31, the clock signal lines GCLKs and the reverse clock signal lines RCLKs of the level shifter 135 may be wired such that they are arranged on the external substrate PCB, a flexible film (COF selected from COFa to COFc), and the non-display area NA of the display panel, as shown in FIG. 34.

Figure 35:
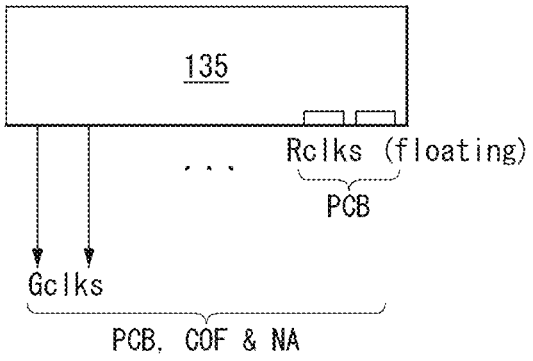

When the display device is configured as shown in FIG. 31, the clock signal lines GCLKs of the level shifter 135 may be wired such that they are arranged on the external substrate PCB, a flexible film (COF selected from COFa to COFc), and the non-display area NA of the display panel, as shown in FIG. 35.

However, the reverse clock signal lines RCLKs may be wired such that they are arranged only on the external substrate PCB. Further, the reverse clock signal lines RCLKs may be deleted (omitted) and only reverse clock signal pads may be provided in an electrically floated state.

Methods of arranging and wiring clock signal lines and reverse clock signal lines have been described in the ninth embodiment of the present invention. However, a method of wiring the clock signal lines GCLKs and the reverse clock signal line RCLKs may be configured by combining one or more of the methods of FIGS. 32 to 35.

FIGS. 36 to 41 are diagrams for describing examples of arrangement and wiring of a display device and a level shifter according to a tenth embodiment of the present invention.

Hereinafter, examples of arrangement and wiring of the level shifter 135 will be described using, as an example, the display device including the display panel 150, the flexible films COFa to COFc, the data drivers 140*a* to 140*c*, the external substrate PCB, and the level shifter 135 as shown in FIG. 31 with reference to FIGS. 36 to 41. However, this is merely an example and the present invention is not limited thereto.

Figure 36:
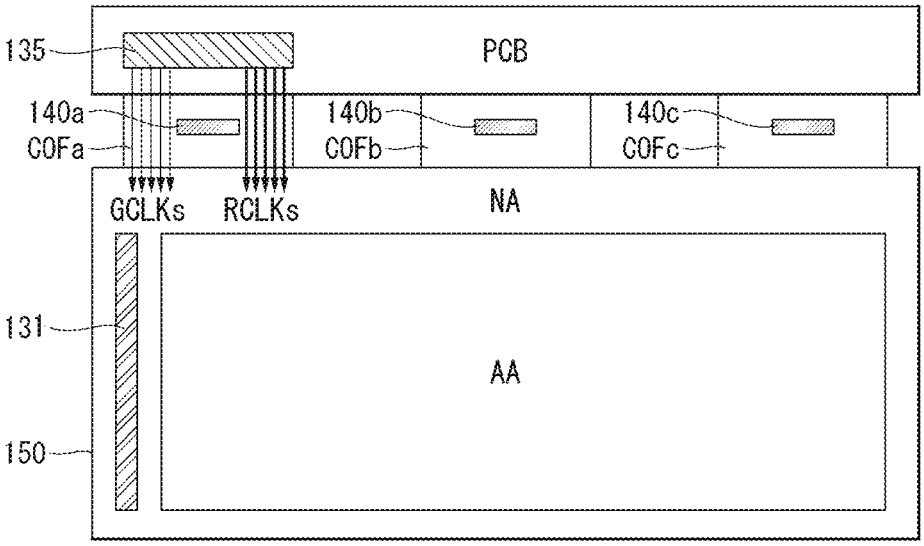
FIGS. 36 to 41 are diagrams for describing examples of arrangement and wiring of a display device and a level shifter according to a tenth embodiment of the present invention.

As shown in FIG. 36, M (M being an integer equal to or greater than 4) clock signal lines GCLKs and M reverse clock signal lines RCLKs are connected to the level shifter 135. The clock signal lines GCLKs and the reverse clock signal lines RCLKs may be wired on the external substrate PCB, the first flexible film COFa, and the non-display area NA of the display panel 150. The clock signal lines GCLKs may be wired such that they pass through one side (e.g., the left side) of the first data driver 140*a* and the reverse clock signal lines RCLKs may be wired such that they pass through the other side (e.g., the right side) of the first data driver 140*a*.

Figure 37:
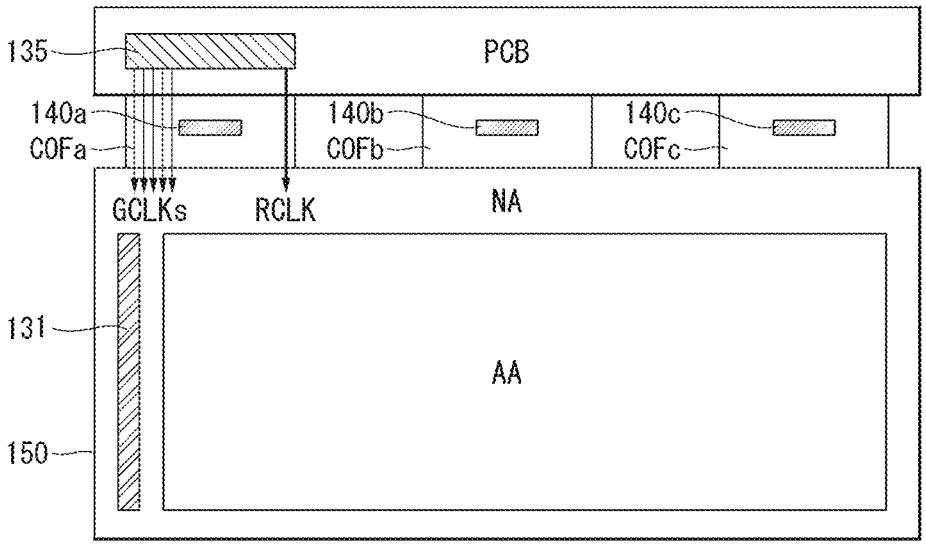

As shown in FIG. 37, M clock signal lines GCLKs and one reverse clock signal line RCLK may be connected to the level shifter 135. The clock signal lines GCLKs and the reverse clock signal line RCLK may be wired on the external substrate PCB, the first flexible film COFa, and the non-display area NA of the display panel 150. The clock signal lines GCLKs may be wired such that they pass through one side (e.g., the left side) of the first data driver 140*a* and the reverse clock signal line RCLK may be wired such that it passes through the other side (e.g., the right side) of the first data driver 140*a*.

Figure 38:
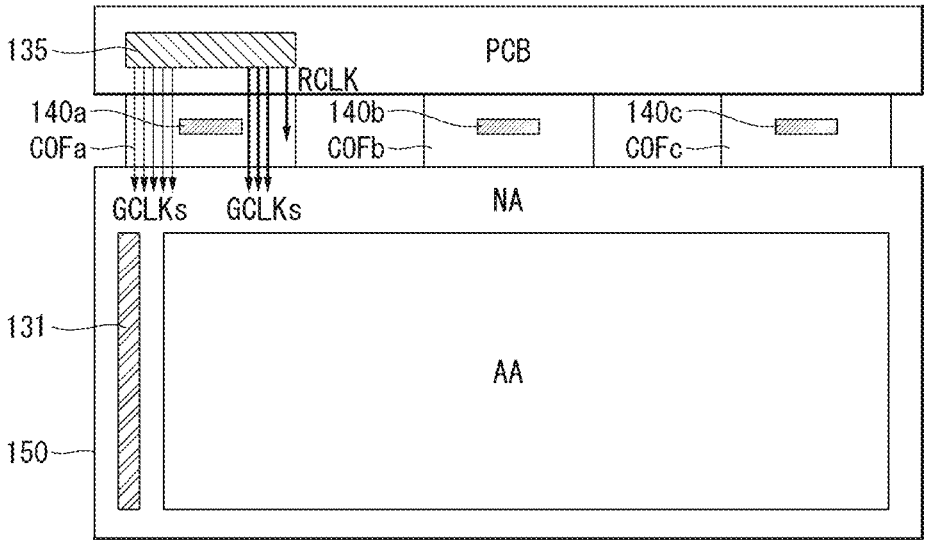

As shown in FIG. 38, M clock signal lines GCLKs and one reverse clock signal line RCLK may be connected to the level shifter 135. The clock signal lines GCLKs may be wired on the external substrate PCB, the first flexible film COFa, and the non-display area NA of the display panel 150 and the reverse clock signal line RCLK may be wired on the external substrate PCB and the first flexible film COFa. The clock signal lines GCLKs may be wired such that they pass through one side (e.g., the left side) and the other side (e.g., the right side) of the first data driver 140*a* evenly or unevenly and the reverse clock signal line RCLK may be wired such that it passes through the other side (e.g., the right side) of the first data driver 140*a*.

Figure 39:
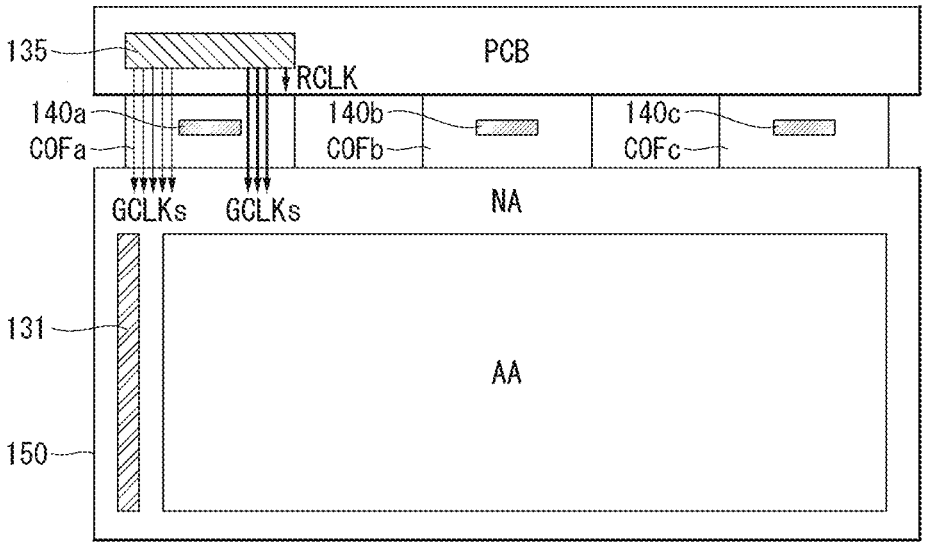

As shown in FIG. 39, M clock signal lines GCLKs and one reverse clock signal line RCLK may be connected to the level shifter 135. The clock signal lines GCLKs may be wired on the external substrate PCB, the first flexible film COFa, and the non-display area NA of the display panel 150 and the reverse clock signal line RCLK may be wired only on the external substrate PCB. The clock signal lines GCLKs may be wired such that they pass through one side (e.g., the left side) and the other side (e.g., the right side) of the first data driver 140*a* evenly or unevenly and the reverse clock signal line RCLK may be wired such that it is adjacent to the other side (e.g., the right side) of the first data driver 140*a*.

Figure 40:
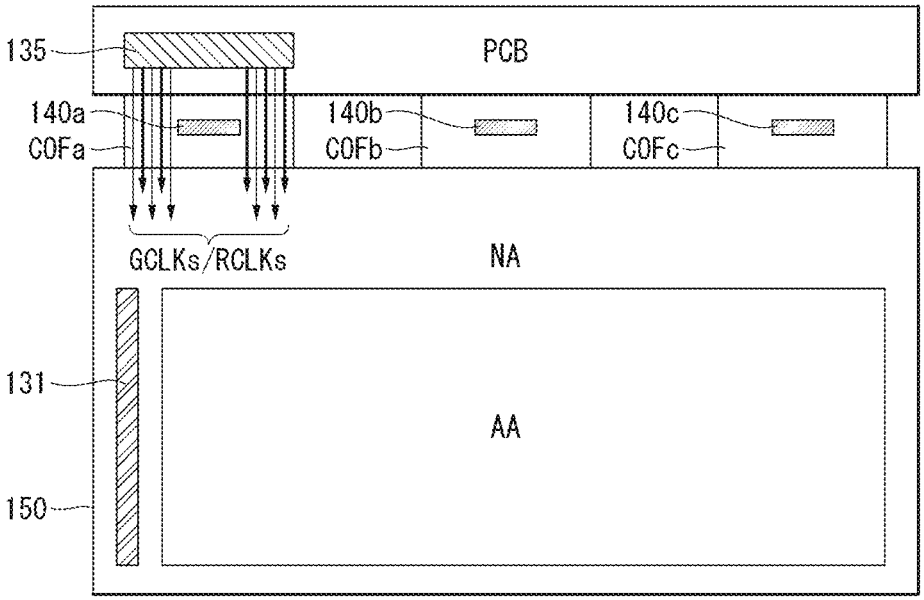

As shown in FIG. 40, M (M being an integer equal to or greater than 4) clock signal lines GCLKs and M reverse clock signal lines RCLKs are connected to the level shifter 135. The clock signal lines GCLKs and the reverse clock signal lines RCLKs may be wired on the external substrate PCB, the first flexible film COFa, and the non-display area NA of the display panel 150. The clock signal lines GCLKs and the reverse clock signal lines RCLKs may be alternately arranged and may be wired such that they pass through one side (e.g., the left side) and the other side (e.g., the right side) of the first data driver 140*a* evenly or unevenly.

Figure 41:
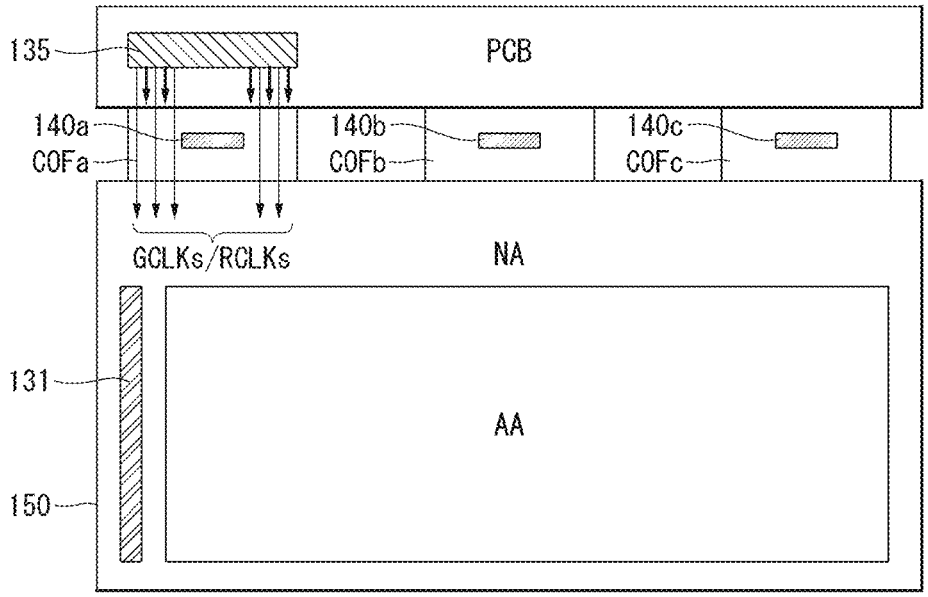

As shown in FIG. 41, M (M is an integer equal to or greater than 4) clock signal lines GCLKs and M reverse clock signal lines RCLKs are connected to the level shifter 135. The clock signal lines GCLKs may be wired on the external substrate PCB, the first flexible film COFa, and the non-display area NA of the display panel 150 and the reverse clock signal lines RCLKs may be wired only on the external substrate PCB. The clock signal lines GCLKs and the reverse clock signal lines RCLKs may be alternately arranged and may be wired such that they pass through one side (e.g., the left side) and the other side (e.g., the right side) of the first data driver 140*a* evenly or unevenly.

Methods of wiring clock signal lines and reverse clock signal lines in consideration of the configurations and forms of clock signals and the configuration and size of the display device have been described in the tenth embodiment of the present invention. However, a method of wiring the clock signal lines GCLKs and the reverse clock signal lines RCLKs may be configured by combining one or more of the methods of FIGS. 36 to 41.

As can be ascertained from the above-described embodiments, the level shifter 135 can have only reverse clock signal pads through which a reverse clock signal can be generated instead of reverse clock signal lines RCLKs. In addition, the reverse clock signal lines RCLKs or the reverse clock signal pads can maintain an electrically floated state without being connected to other circuits.

Accordingly, at least one of the examples of FIGS. 36 to 41 includes a configuration having a floating reverse clock signal pad. Additionally, the clock signal lines GCLKs shown in FIGS. 36 to 41 are connected to the shift register circuit 131, whereas the reverse clock signal lines RCLKs (including reverse clock signal pads) are neither connected to the shift register circuit 131 nor any other circuits. Further, a reverse clock signal, a reverse clock signal line and a reverse clock signal pad may be configured in other forms by referring to and combining the first to tenth embodiments of the present invention.

FIGS. 42 to 45 are diagrams for describing a degree of improvement in electromagnetic interference according to signal forms. FIGS. 42 to 45 are based on simulation results.

Figure 42:
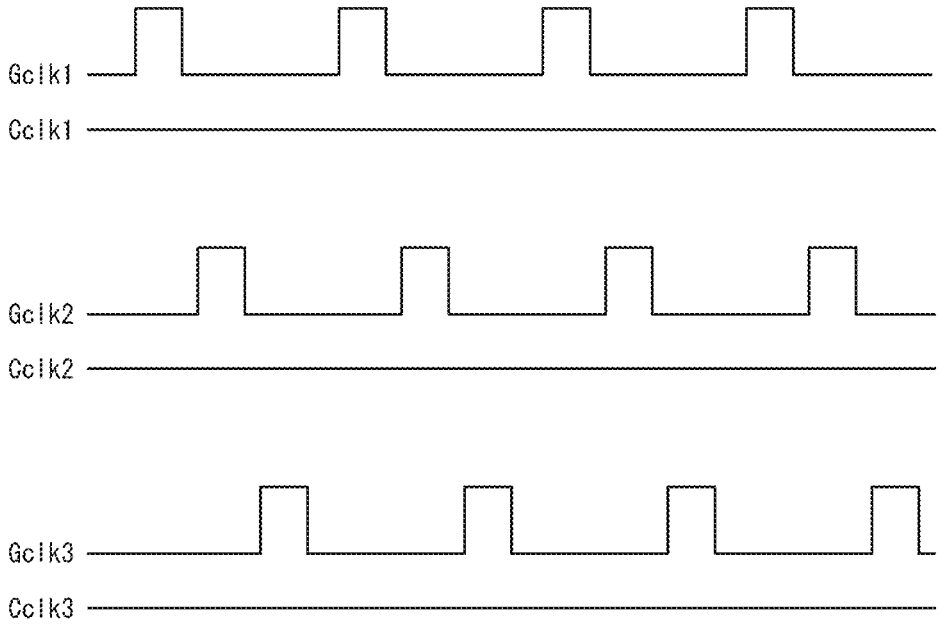
FIGS. 42 to 45 are diagrams for describing a degree of improvement in electromagnetic interference according to signal forms.

As shown in FIG. 42, a level shifter is implemented such that it generates first to third clock signals Gclk1 to Gclk3 having logic high pulses that do not overlap in the entire period and first to third compensation clock signals Cclk1 to Cclk3 having logic high (or logic low) pulses. As a result of an EMI test performed on a level shifter having the output waveform of FIG. 42, the result of FIG. 43 was obtained.

Figure 44:
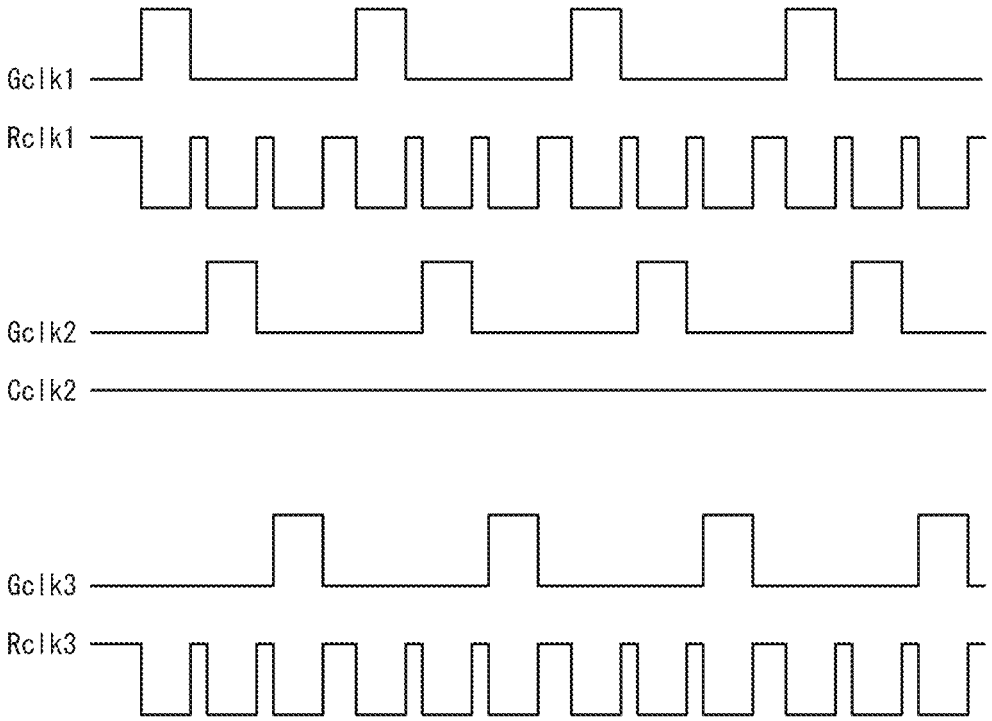

As shown in FIG. 44, a level shifter is implemented such that it generates first to third clock signals Gclk1 to Gclk3 having logic high pulses that do not overlap in the entire period, first and third reverse clock signals Rclk1 and Rclk3 having repeated logic high pluses and logic low pulses, and a second compensation clock signal Cclk2 having logic high (or logic low) pulses. As a result of EMI test performed on a level shifter having the output waveform of FIG. 44, the result of FIG. 45 was obtained.

Figure 43:
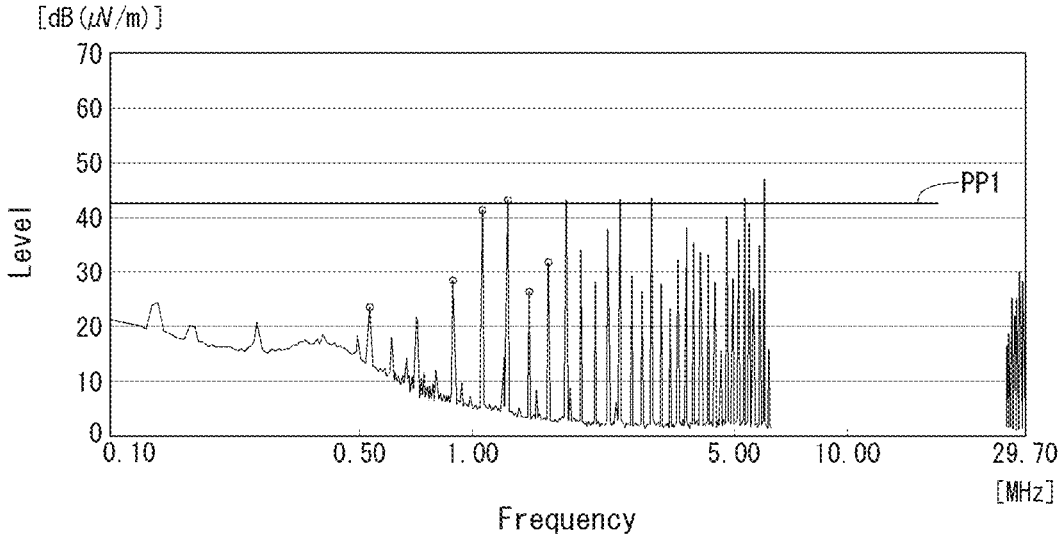
Figure 45:
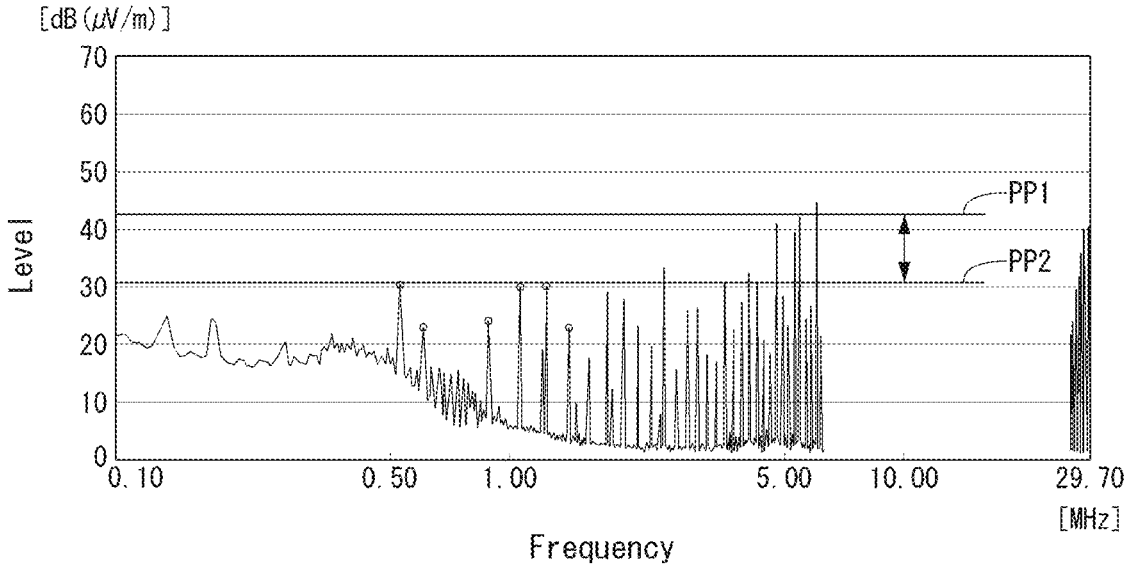

As can be ascertained from comparison of "PP1" of FIG. 43 with "PP1 and PP2" of FIG. 45, an EMI occurrence rate can be reduced when a reverse clock signal is configured such that it has a phase reverse to that of a clock signal. Accordingly, the present invention can generate and write a reverse clock signal that can decrease a level increase in a specific frequency band of a clock signal to improve or complement problems that may be caused by EMI.

As described above, the present invention can improve or complement problems that may be caused by EMI. Furthermore, the present invention can provide a scan driver including a level shifter and a shift register circuit robust against EMI. Moreover, the present invention can provide a display device having a scan driver which is robust against EMI and thus it can guarantee a smooth output state (characteristics, level, reliability, and the like) even when EMI occurs.

It will be apparent to those skilled in the art that various modifications and variations can be made in the level shifter and the display device including the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel configured to display images; and a level shifter including:

a signal pad through which a clock signal to drive the display panel is output; and a reverse signal pad through which a reverse clock signal having a reverse phase with the clock signal is output, wherein the reverse signal pad is in an electrically floating state, and wherein the reverse signal pad is electrically separated from a shift register circuit for outputting scan signals to be supplied to the display panel.

2. The display device of claim 1, further comprising:
a clock signal line connected to the signal pad; and
a reverse clock signal line connected to the reverse signal pad,
wherein the signal pad is connected to the shift register circuit through the clock signal line, and
wherein the reverse signal pad is connected to the reverse clock signal line while maintaining an electrically floating state.

3. The display device of claim 2, further comprising:
an external substrate on which the level shifter is positioned;
a flexible film connecting the display panel to the external substrate; and
a data driver positioned on the flexible film and supplying a data signal to the display panel,
wherein the reverse clock signal line is wired on at least one of: the external substrate, the flexible film, and the display panel.

4. The display device of claim 2, wherein:
the clock signal line includes a plurality of clock signal lines;
the reverse clock signal line includes a plurality of reverse clock signal lines; and
the number of clock signal lines is equal to or different from the number of reverse clock signal lines.

5. The display device of claim 4, wherein the plurality of clock signal lines and the plurality of reverse clock signal lines are alternately wired.

6. The display device of claim 4, wherein the reverse clock signal line includes a plurality of reverse clock signal lines arranged at a point where the plurality of clock signal lines is divided into two parts.

7. The display device of claim 2, wherein the reverse clock signal line is disposed in proximity to:
a first clock signal line through which a first clock signal is output; and
a last clock signal line through which a last clock signal is output.

8. The display device of claim 7, wherein a plurality of clock signal lines and only one reverse clock signal line are provided.

9. The display device of claim 1, wherein a level of the reverse clock signal differs from a level of the clock signal.

10. The display device of claim 1, wherein at least one of a pulse generation time and a pulse end time of the reverse clock signal differs from that of the clock signal.

11. A level shifter, comprising:
a signal pad through which a clock signal is output; and
a reverse signal pad through which a reverse clock signal having a reverse phase with the clock signal is output,
wherein the reverse signal pad is in an electrically floating state, and
wherein the reverse signal pad is electrically separated from a circuit for outputting scan signals.

12. The level shifter of claim 11, further comprising:
a clock signal line connected to the signal pad; and
a reverse clock signal line connected to the reverse signal pad,
wherein the signal pad is connected to the circuit through the clock signal line, and
wherein the reverse signal pad is connected to the reverse clock signal line while maintaining an electrically floating state.

13. The level shifter of claim 11, wherein:
the clock signal line includes a plurality of clock signal lines;
the reverse clock signal line includes a plurality of reverse clock signal lines; and
the plurality of clock signal lines and the plurality of reverse clock signal lines are alternately wired.

14. The level shifter of claim 11, wherein a level of the reverse clock signal differs from a level of the clock signal.

15. The level shifter of claim 11, wherein at least one of a pulse generation time and a pulse end time of the reverse clock signal differs from that of the clock signal.

* * * * *